US012042010B2

(12) United States Patent
Fusaro et al.

(10) Patent No.: US 12,042,010 B2
(45) Date of Patent: Jul. 23, 2024

(54) CONVERTIBLE HIGH HEEL AND FLAT SHOE AND METHOD OF USE

(71) Applicant: Viceversa Lab, Inc., Los Angeles, CA (US)

(72) Inventors: Alanna Elise Fusaro, Los Angeles, CA (US); Karl Biewald, Saint Paul, MN (US)

(73) Assignee: VICEVERSA LAB, INC., Los Angeles, CA (US)

( * ) Notice: Subject to any disclaimer, the term of this patent is extended or adjusted under 35 U.S.C. 154(b) by 193 days.

(21) Appl. No.: 17/566,516

(22) Filed: Dec. 30, 2021

(65) Prior Publication Data

US 2022/0117358 A1 Apr. 21, 2022

Related U.S. Application Data

(63) Continuation-in-part of application No. 16/821,876, filed on Mar. 17, 2020, now Pat. No. 11,213,099.

(60) Provisional application No. 63/140,636, filed on Jan. 22, 2021, provisional application No. 62/821,820, filed on Mar. 21, 2019.

(51) Int. Cl.

| | |
|---|---|
| ***A43B 21/433*** | (2006.01) |
| ***A43B 21/42*** | (2006.01) |
| ***A43B 21/48*** | (2006.01) |

(52) U.S. Cl.

CPC ..... *A43B 21/42* (2013.01); *A43B 21/433* (2013.01); *A43B 21/48* (2013.01)

(58) Field of Classification Search

CPC ..... A43B 21/42; A43B 21/433; A43B 21/48; A43B 13/141; A43B 13/14

See application file for complete search history.

(56) References Cited

U.S. PATENT DOCUMENTS

| | | | | |
|---|---|---|---|---|
| 5,309,651 | A | 5/1994 | Handel | |
| 9,289,025 | B2 | 3/2016 | Damodar | |
| D874,116 | S * | 2/2020 | Avecilla | D2/966 |
| 11,213,099 | B2 * | 1/2022 | Fusaro | A43B 7/38 |

(Continued)

FOREIGN PATENT DOCUMENTS

| | | |
|---|---|---|
| CN | 102793338 A | 11/2012 |
| CN | 112120346 A | 11/2012 |

(Continued)

OTHER PUBLICATIONS

International Search Report and Written Opinion dated Jul. 13, 2020 for related PCT Application PCT/US2020/023409 (10 pages).

(Continued)

*Primary Examiner* — Ted Kavanaugh

(74) *Attorney, Agent, or Firm* — Procopio, Cory, Hargreaves & Savitch LLP

(57) ABSTRACT

A convertible high heel and flat shoe comprising a sole including a heel section; a high heel piece positionable between a high heel mode where the high heel piece supports the heel section and a flat shoe mode where the high heel piece is received within the sole, wherein the sole includes a receiving section to receive the high heel piece within the sole, an openable sole cover that covers and uncovers the receiving section of the sole, the openable sole cover including a hole therein that the high heel piece extends through in the high heel mode.

19 Claims, 28 Drawing Sheets

(56) References Cited

U.S. PATENT DOCUMENTS

| | | | | |
|---|---|---|---|---|
| 2007/0289167 | A1* | 12/2007 | Pieriboni | A43B 3/24 36/100 |
| 2008/0184598 | A1 | 8/2008 | Handel et al. | |
| 2010/0071233 | A1* | 3/2010 | Savill, Jr. | A43B 3/24 36/105 |
| 2010/0083537 | A1* | 4/2010 | Wierda | A43B 13/16 36/100 |
| 2013/0333246 | A1* | 12/2013 | Weller | A43B 3/26 36/103 |
| 2015/0113837 | A1 | 4/2015 | Isinhue | |
| 2018/0049516 | A1* | 2/2018 | Chiang | A43B 21/433 |
| 2018/0213889 | A1* | 8/2018 | Riebe | A43B 21/433 |
| 2019/0037965 | A1* | 2/2019 | Avecilla | A43B 13/14 |
| 2021/0037918 | A1* | 2/2021 | Mao | A43B 21/52 |

FOREIGN PATENT DOCUMENTS

| | | | | | |
|---|---|---|---|---|---|
| CN | 102793338 | B | | 1/2015 | |
| CN | 204091141 | A | | 1/2015 | |
| CN | 109123898 | A | | 1/2019 | |
| EP | 3434133 | A1 | | 1/2019 | |
| GB | 2497587 | A | * | 6/2013 | A43B 21/433 |
| WO | 2012054981 | A2 | | 5/2012 | |
| WO | 2020191085 | A1 | | 9/2020 | |

OTHER PUBLICATIONS

International Search Report dated May 2, 2022 in related PCT Application PCT/US2022/012334 (4pages).
Office Action dated Mar. 8, 2024 in Australian Patent Application No. 2020241747.

* cited by examiner

CONVERTIBLE HIGH HEEL AND FLAT SHOE AND METHOD OF USE

CROSS REFERENCE TO RELATED APPLICATIONS

This application is a continuation in part of U.S. patent application Ser. No. 16/821,876, filed Mar. 17, 2020, now U.S. Pat. No. 11,213,099, which claims priority to U.S. provisional patent application No. 62/821,820, filed Mar. 21, 2019, under 35 USC 119. This application also claims priority to U.S. provisional patent application No. 63/140,636, filed Jan. 22, 2021, under 35 USC 119. The above patent applications are incorporated by reference herein.

FIELD OF THE INVENTION

The present invention relates to a shoe that is convertible between a high heel shoe configuration and a flat shoe configuration.

SUMMARY OF THE INVENTION

An aspect of the invention involves a convertible high heel and flat shoe, comprising a sole including a heel section; and a high heel piece positionable between a high heel mode where the high heel piece supports the heel section and a flat shoe mode where the high heel piece is received within the sole.

One or more implementations of the aspect of the invention described immediately above includes one or more of the following: a hinge mechanism hingeably connecting the high heel piece to the sole; the high heel piece, the heel section, and the hinge mechanism form a triangle shaped structure; the heel section includes high heel piece receiving member to secure the high heel piece receiving member to the heel section in the high heel mode; the heel section includes a rear area and the high heel piece receiving member is in the rear area of the heel section; the heel section includes a central area and the high heel piece receiving member is in the central area of the heel section; the high heel piece receiving member is a tube that receives a top of the high heel piece; the high heel piece includes a top threaded section that is threadably receivable in the high heel piece receiving member; the high heel piece includes a pull release mechanism whereby when pulled away from the heel section the high heel piece unlocks from the high heel piece receiving member; a high heel piece locking mechanism to lock the high heel piece into a high heel position, the high heel piece locking mechanism having a pin with an overhang and a cooperating member with retaining shelf section and a gap, whereby rotation of at least one of the pin and the cooperating member causes the overhang to be retained on the retaining shelf section so that the high heel piece is locked in the high heel position and aligned with the gap, causing the overhang to fall there through, so that the high heel piece is unlocked from the high heel position; a high heel piece locking mechanism whereby rotation of the heel section causes the high heel piece to lock into and unlock from the high heel position; a high heel piece locking mechanism whereby rotation of the high heel piece causes the high heel piece to lock into and unlock from the high heel position; the sole includes a receiving section to receive the high heel piece within the sole, and further including a guiding linkage mechanism that guides the high heel piece towards the receiving section of the sole; the sole includes a receiving section to receive the high heel piece within the sole, and openable sole cover that covers and uncovers the receiving section of the sole; a shorter heel that is separate from and shorter than the high heel piece and a linkage mechanism that movably couples the shorter heel to the heel section and the high heel piece, whereby the shorter heel moves forward and rearward with movement of the high heel piece; a shorter heel that is separate from and shorter than the high heel piece, and is linearly and movably coupled to the heel section, whereby the shorter heel moves forward and rearward in a linear fashion; a stationary shorter heel that is separate from and shorter than the high heel piece, and the high heel piece includes a heel cover piece that covers the shorter heel when the convertible high heel and flat shoe is in high heel mode; a tube that receives the high heel piece and linkage mechanism that causes the tube to be covered when the high heel piece is moved out of the high heel mode; a shorter heel that is separate from and shorter than the high heel piece, and a slide wedge between the shorter heel and the sole to help distribute weight load; a spring between the heel section and the shorter heel to urge the shorter heel away from the heel section to control movement of the shorter heel; a toe section, an area where the toe section is coupled to the sole section, and a latch locking mechanism in the area to lock and unlock the sole relative to the toe section to convert between a high heel mode and a flat mode; the sole includes a high heel piece receiving section and the latch locking mechanism is configured to disengage upon receipt of the high heel piece in the high heel piece receiving section; the sole includes a receiving section to receive the high heel piece within the sole, an openable sole cover that covers and uncovers the receiving section of the sole, and the latch locking mechanism is configured to disengage upon uncovering of the receiving section by the openable sole cover; the latch locking mechanism is configured to stay disengaged by the high heel piece disposed within the receiving section in the sole; and/or the sole includes indents to hold at least one of foam and flexible material for comfort.

Another aspect of the invention involves a convertible high heel and flat shoe, comprising a sole including a heel section and a pivot point; a high heel piece positionable between a high heel mode where the high heel piece supports the heel section and a flat shoe mode where the high heel piece is received within the sole, the high heel piece including a pivot point, and a linkage between the pivot point on the sole and the pivot point on the high heel piece whereby the high heel piece, the heel section, and the linkage form a triangle shaped structure.

One or more implementations of the aspect of the invention described immediately above includes one or more of the following: a hinge mechanism hingeably connecting the high heel piece to the sole; the high heel piece, the heel section, and the hinge mechanism form a triangle structure; the heel section includes high heel piece receiving member to secure the high heel piece receiving member to the heel section in the high heel mode; the heel section includes a rear area and the high heel piece receiving member is in the rear area of the heel section; the heel section includes a central area and the high heel piece receiving member is in the central area of the heel section; the high heel piece receiving member is a tube that receives a top of the high heel piece; the high heel piece includes a top threaded section that is threadably receivable in the high heel piece receiving member; the high heel piece includes a pull release mechanism whereby when pulled away from the heel section the high heel piece unlocks from the high heel piece receiving member; a high heel piece locking mechanism to lock the high heel piece into a high heel position, the high heel piece locking mechanism having a pin with an overhang and a cooperating member with retaining shelf section and a gap, whereby rotation of at least one of the pin and the cooperating member causes the overhang to be retained on the retaining shelf section so that the high heel piece is locked in the high heel position and aligned with the gap, causing the overhang to fall there through, so that the high heel piece is unlocked from the high heel position; a high heel piece locking mechanism whereby rotation of the heel section causes the high heel piece to lock into and unlock from the high heel position; a high heel piece locking mechanism whereby rotation of the high heel piece causes the high heel piece to lock into and unlock from the high heel position; the sole includes a receiving section to receive the high heel piece within the sole, and further including a guiding linkage mechanism that guides the high heel piece towards the receiving section of the sole; the sole includes a receiving section to receive the high heel piece within the sole, and openable sole cover that covers and uncovers the receiving section of the sole; a shorter heel that is separate from and shorter than the high heel piece and a linkage mechanism that movably couples the shorter heel to the heel section and the high heel piece, whereby the shorter heel moves forward and rearward with movement of the high heel piece; a shorter heel that is separate from and shorter than the high heel piece, and is linearly and movably coupled to the heel section, whereby the shorter heel moves forward and rearward in a linear fashion; a stationary shorter heel that is separate from and shorter than the high heel piece, and the high heel piece includes a heel cover piece that covers the shorter heel when the convertible high heel and flat shoe is in high heel mode; a tube that receives the high heel piece and linkage mechanism that causes the tube to be covered when the high heel piece is moved out of the high heel mode; a shorter heel that is separate from and shorter than the high heel piece, and a slide wedge between the shorter heel and the sole to help distribute weight load; a spring between the heel section and the shorter heel to urge the shorter heel away from the heel section to control movement of the shorter heel; a toe section, an area where the toe section is coupled to the sole section, and a latch locking mechanism in the area to lock and unlock the sole relative to the toe section to convert between a high heel mode and a flat mode; the sole includes a high heel piece receiving section and the latch locking mechanism is configured to disengage upon receipt of the high heel piece in the high heel piece receiving section; the sole includes a receiving section to receive the high heel piece within the sole, openable sole cover that covers and uncovers the receiving section of the sole, and the latch locking mechanism is configured to disengage upon uncovering of the receiving section by the removable sole cover; the latch locking mechanism is configured to stay disengaged by the high heel piece disposed within the receiving section in the sole; and/or the sole includes indents to hold at least one of foam and flexible material for comfort.

Convertible shoe where the heel locks, unlocks and moves relative to the body of the shoe. The heel stored within the shoe and is coverable by the sole. The arch/shape of the shoe changes between heel mode and flat mode.

Another aspect of the invention involves a convertible high heel and flat shoe comprising a sole including a heel section; a high heel piece positionable between a high heel mode where the high heel piece supports the heel section and a flat shoe mode where the high heel piece is received within the sole, wherein the sole includes a receiving section to receive the high heel piece within the sole, an openable sole cover that covers and uncovers the receiving section of the sole, the openable sole cover including a hole therein that the high heel piece extends through in the high heel mode.

One or more implementations of the aspect of the invention described immediately above includes one or more of the following: the sole includes a midsole with an adaptable arc and shape between the high heel mode and the flat shoe mode, the sole includes a hinge or flexure with a lock configured to automatically lock when the high heel piece is positioned in the high heel mode and automatically unlock when the high heel piece is positioned in the flat mode; the lock includes a hinge, a groove, and a wedge piece wherein, in a lock mode and the high heel mode, the wedge piece uses spring force to push into the groove of the lock, preventing the hinge from moving freely, and, in an unlock mode or the flat shoe mode, the wedge piece is moved out of the groove, allowing the hinge to move freely; a rod and notch combination to prevent hinge motion in one direction; the wedge piece prevents movement in direction opposite the one direction; a heel locking mechanism configured to lock in the high heel mode where the high heel piece supports the heel section and unlock in the flat shoe mode where the high heel piece is received within the sole; the openable sole cover is removably attachable with respect to the sole; and/or the openable sole cover is configured to be walked on, contacting a walking surface, in the flat shoe mode.

An additional aspect of the invention involves a convertible high heel and flat shoe comprising a sole including a heel section; a high heel piece positionable between a high heel mode where the high heel piece supports the heel section and a flat shoe mode where the high heel piece is received within the sole, wherein the sole includes a midsole with an adaptable arc and shape between the high heel mode and the flat shoe mode, the sole includes a hinge or flexure with a lock configured to automatically lock when the high heel piece is positioned in the high heel mode and automatically unlock when the high heel piece is positioned in the flat mode.

One or more implementations of the aspect of the invention described immediately above includes one or more of the following: the lock includes a hinge, a groove, and a wedge piece wherein, in a lock mode and the high heel mode, the wedge piece uses spring force to push into the groove of the lock, preventing the hinge from moving freely, and, in an unlock mode or the flat shoe mode, the wedge piece is moved out of the groove, allowing the hinge to move freely; a rod and notch combination to prevent hinge motion in one direction; the wedge piece prevents movement in direction opposite the one direction; a heel locking mechanism configured to lock in the high heel mode where the high heel piece supports the heel section and unlock in the flat shoe mode where the high heel piece is received within the sole; the sole includes a receiving section to receive the high heel piece within the sole, an openable sole cover that covers and uncovers the receiving section of the sole, the openable sole cover including a hole therein that the high heel piece extends through in the high heel mode; the openable sole cover is removably attachable with respect to the sole; and/or the openable sole cover is configured to be walked on, contacting a walking surface, in the flat shoe mode.

A further aspect of the invention involves a convertible high heel and flat shoe comprising a sole including a heel section; a high heel piece positionable between a high heel mode where the high heel piece supports the heel section and a flat shoe mode where the high heel piece is received within the sole; a heel locking mechanism configured to lock in the high heel mode where the high heel piece supports the heel section and unlock in the flat shoe mode where the high heel piece is received within the sole.

One or more implementations of the aspect of the invention described immediately above includes one or more of the following: the heel locking mechanism includes a spring-loaded push button to disengage the heel locking mechanism when the high heel piece is in the high heel mode; the heel locking mechanism includes a latch that is engaged when the heel locking mechanism is locked and disengaged when the heel locking mechanism is unlocked; the heel locking mechanism includes a catch with a rearward facing portion and forward facing portion, a latch member with a rearward facing portion and forward facing portion, the rearward facing portion of the catch engages the forward facing forward portion of latch member in the heel mode, and the forward facing portion of the catch engages the rearward facing portion of the latch member in the flat mode; the sole includes a receiving section to receive the high heel piece within the sole, an openable sole cover that covers and uncovers the receiving section of the sole, the openable sole cover including a hole therein that the high heel piece extends through in the high heel mode; the sole includes a midsole with an adaptable arc and shape between the high heel mode and the flat shoe mode, the sole includes a hinge or flexure with a lock configured to automatically lock when the high heel piece is positioned in the high heel mode and automatically unlock when the high heel piece is positioned in the flat mode; the openable sole cover is removably attachable with respect to the sole; and/or the openable sole cover is configured to be walked on, contacting a walking surface, in the flat shoe mode.

BRIEF DESCRIPTION OF DRAWINGS

The accompanying drawings, which are incorporated in and form a part of this specification illustrate embodiments of the invention and together with the description, serve to explain the principles of the invention.

FIG. 26 is an enlarged perspective view of a sole cover with hole for heel to align through.

DESCRIPTION OF EMBODIMENT OF THE INVENTION

With reference to FIGS. 1A-10, an embodiment of a convertible high heel and flat shoe ("shoe") that is convertible between a high heel shoe configuration and a flat shoe configuration will be described. The shoe solves the problem of uncomfortable high heel shoes by giving a user the option to convert one's heels to a flat when the shoes inevitably become painful. The shoe is great for commuting or anytime one wants the advantage of both a heel and a flat shoe.

Figure 1A:
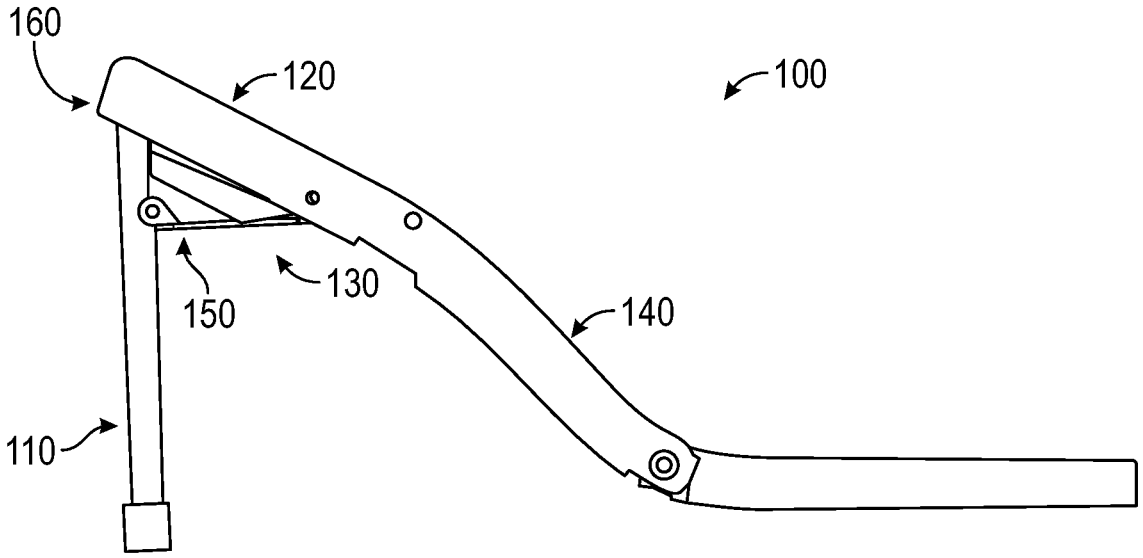
FIG. 1A is a front elevational view of an embodiment of a convertible high heel and flat shoe.

FIG. 1A is a front elevational view of an embodiment of a convertible high heel and flat shoe 100. The shoe 100 includes a high heel piece 110 that is hingeably connected to a heel section 120 via hinge mechanism 130, allowing the high heel piece 110 to fold into a sole 140 to create a flat shoe. The high heel piece 110, heel section 120, and hinge mechanism form a triangle shaped structure or triangular support 150 (e.g., for stability and to support weight load, for aesthetics). FIG. 1A illustrates the shoe 100 in locked position with the triangular support 150 in a rear 160 of the heel section 120. In an alternative embodiment, the high heel piece 110 is detachably connectable to the heel section 120. In such an embodiment, the high heel piece 110 is completely removable and is positionable to support the heel section 120 in a high heel mode and positionable inside the sole 140 in a flat shoe mode.

Figure 1B:
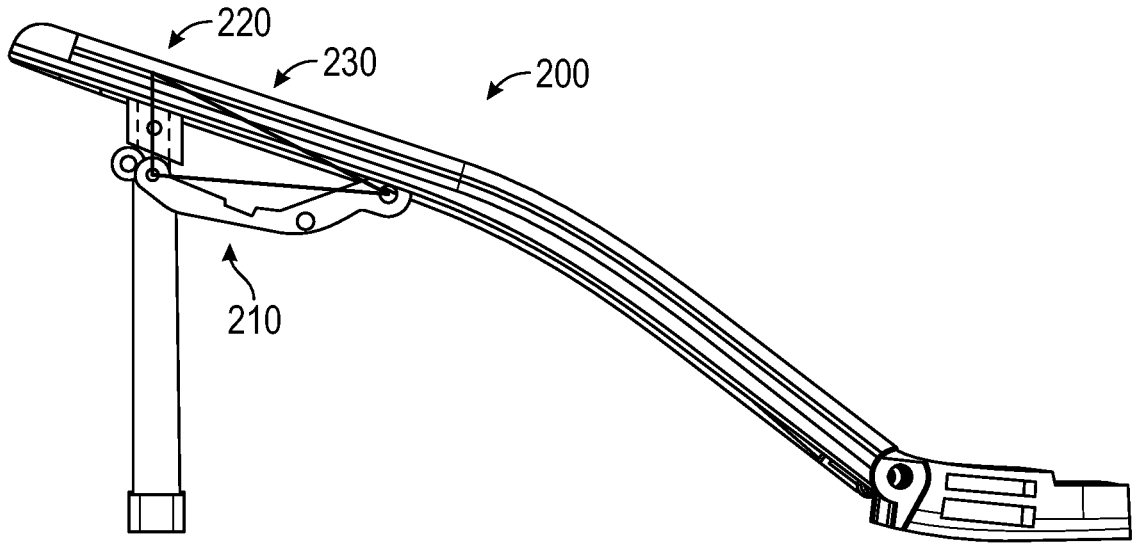
FIG. 1B is a front elevational view of another embodiment of a convertible high heel and flat shoe.

FIG. 1B illustrates another embodiment of a convertible high heel and flat shoe 200 with a triangular support 210 illustrated in a middle 220 of a heel section 230. As illustrated in FIGS. 1A, 1B, placement of the triangle support 210 may be in multiple locations.

Figure 2A:
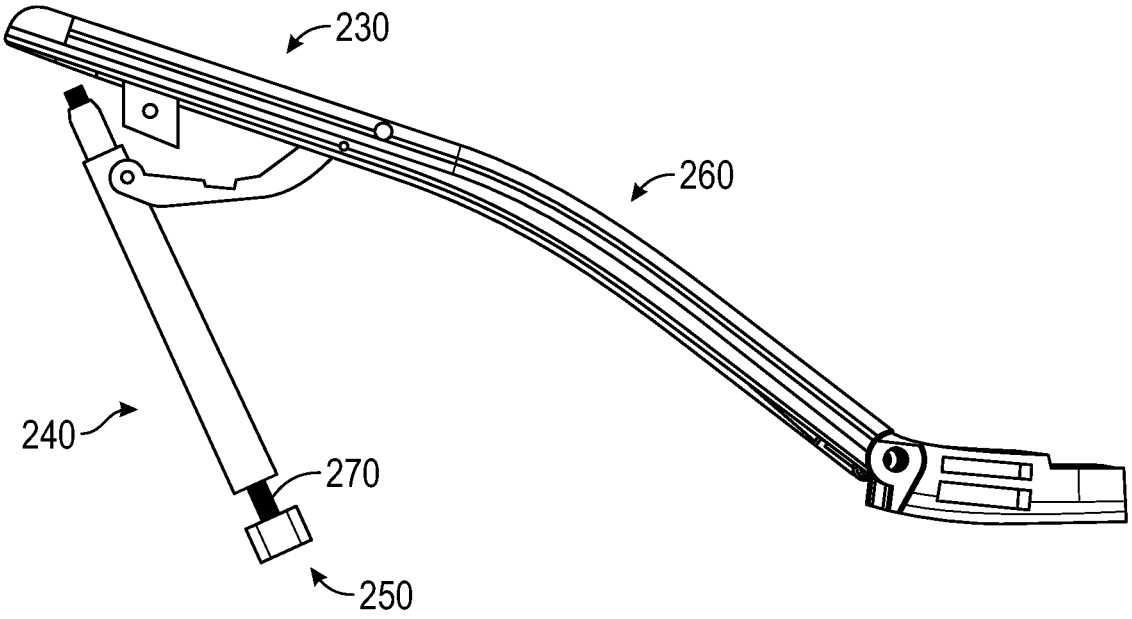
FIG. 2A is a front elevational view of the convertible high heel and flat shoe of FIG. 1A, and shows a high heel piece detached from a heel and pivoted towards a sole.

FIG. 2A illustrates how a high heel piece 240 detaches from the heel section 230 by a twist release mechanism 250 and pivoted towards a sole 260. The twist release mechanism 250 uses a threaded rod or pin 270 through the entire high heel piece 240. The threaded rod or pin 270 is twisted to release the high heel piece 240 from the heel section 230.

Figure 2B:
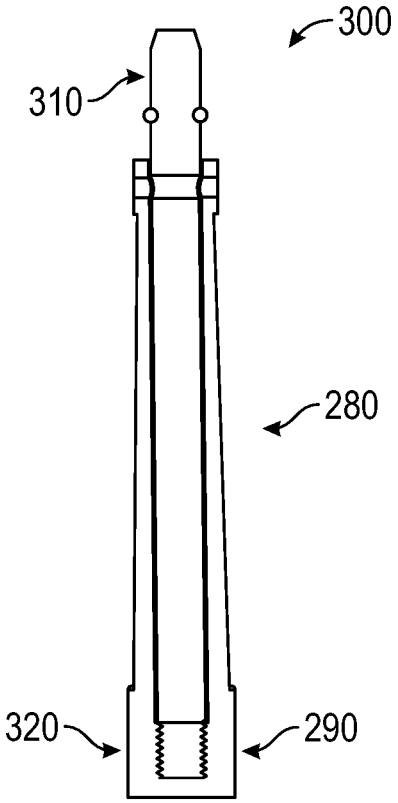
FIG. 2B is a cross-sectional view of an embodiment of a high heel piece for a convertible high heel and flat shoe.

FIG. 2B illustrates an embodiment of a high heel piece 280 with a pull release mechanism 290 having ball bearings 300 to hold a center heel pin 310 in place. The ball bearings 300 are on heel/sole interior or on the pin 310. When a user pulls pull member 320 directly downwards, the ball bearings 300 will flex (via a spring) and pin 310 can be removed from the shoe.

Figure 2D:
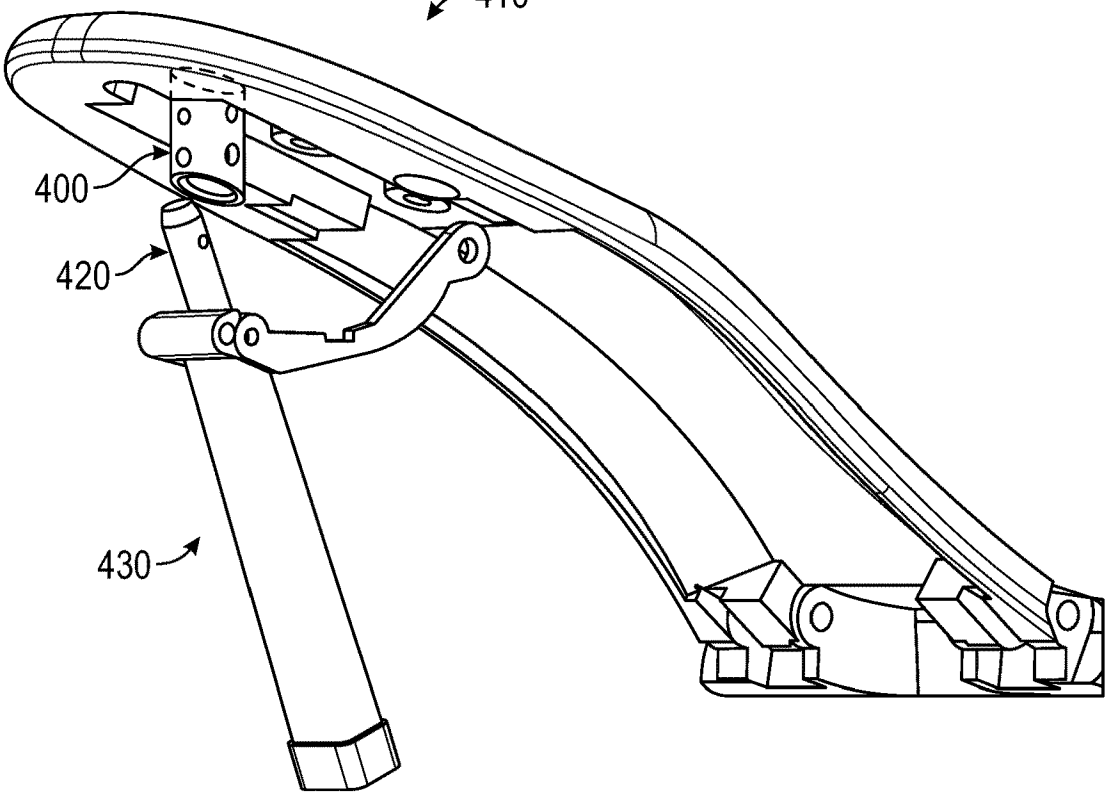
FIG. 2D is a rear perspective view of an embodiment of a convertible high heel and flat shoe, with certain portions not shown for clarity, and a tube shown on a heel of the shown for receiving a high heel piece.
Figure 2C:
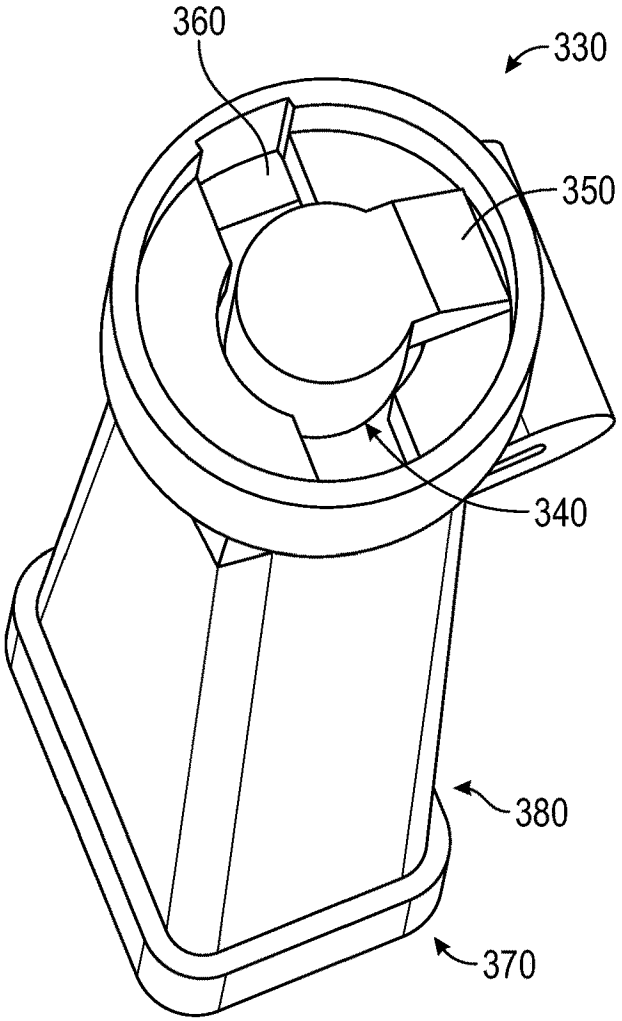
FIG. 2C is a perspective view of an embodiment of a high heel piece locking mechanism.
Figure 2E:
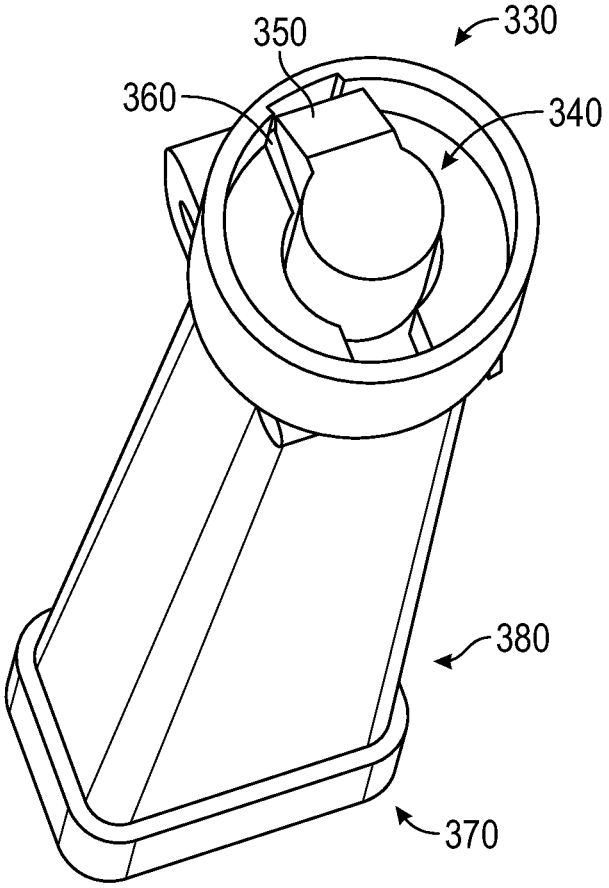
FIG. 2E is a perspective view of another embodiment of a high heel piece locking mechanism.

With reference to FIGS. 2C and 2E, an embodiment of a high heel piece locking mechanism 330 will be described. The high heel piece locking mechanism 330 includes a pin 340 with a flexible cantilever/overhang 350 to lock a high heel piece into a high heel position. To unlock the high heel piece relative to the heel section, the pin 340 is rotated from the position shown in FIG. 2C to the position shown in FIG. 2E, where the overhang 350 aligns with a gap 360 that the overhang 350 falls through. The pin 340 could be rotated by either twisting the heel cap 370 at bottom 380 or by twisting an entire heel section.

FIG. 2D illustrates a tube/cap tube 400 on a heel section 410 for receiving an end 420 of a high heel piece 430. The cap tube 400 may include a telescoping tube.

Figure 3A:
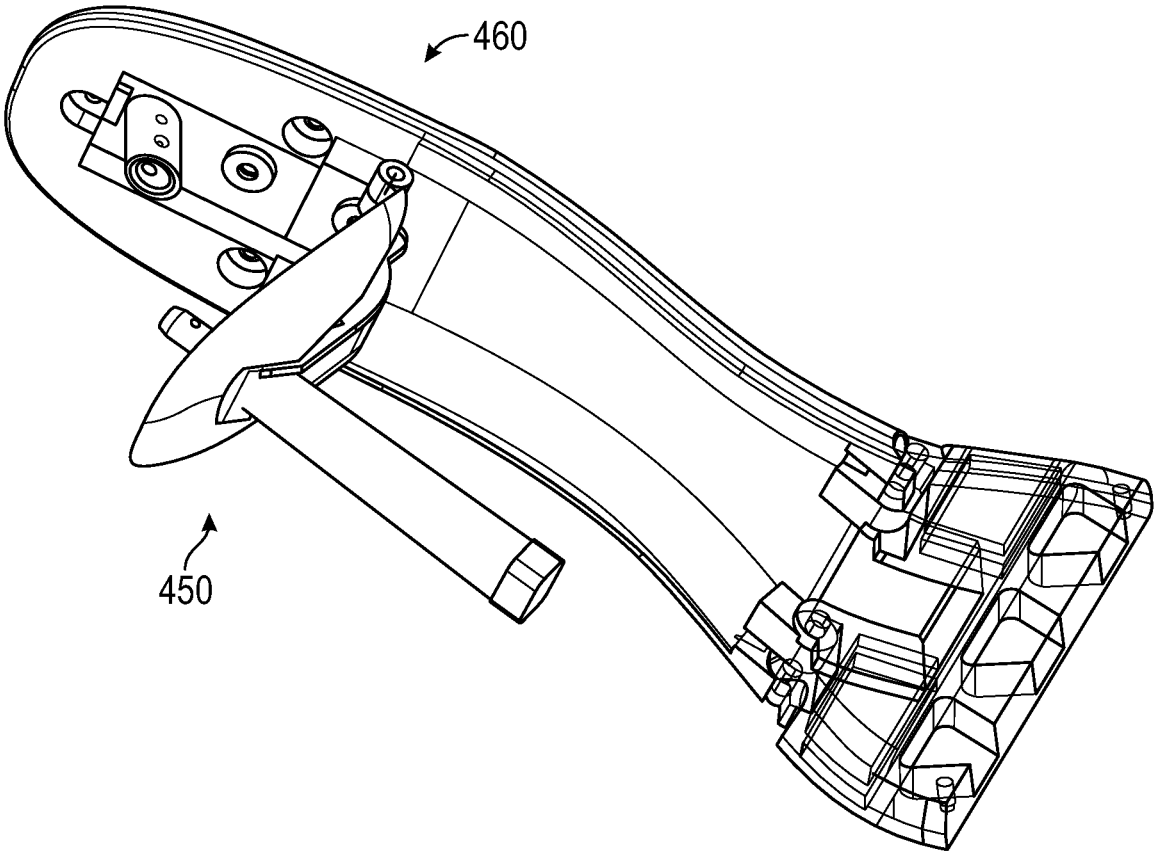
FIG. 3A is a front elevational view of an embodiment of a convertible high heel and flat shoe, with certain portions not shown for clarity, and a two-piece heel in the form of a heel cover piece (with high heel piece) shown hingeably attached to the heel.
Figure 3B:
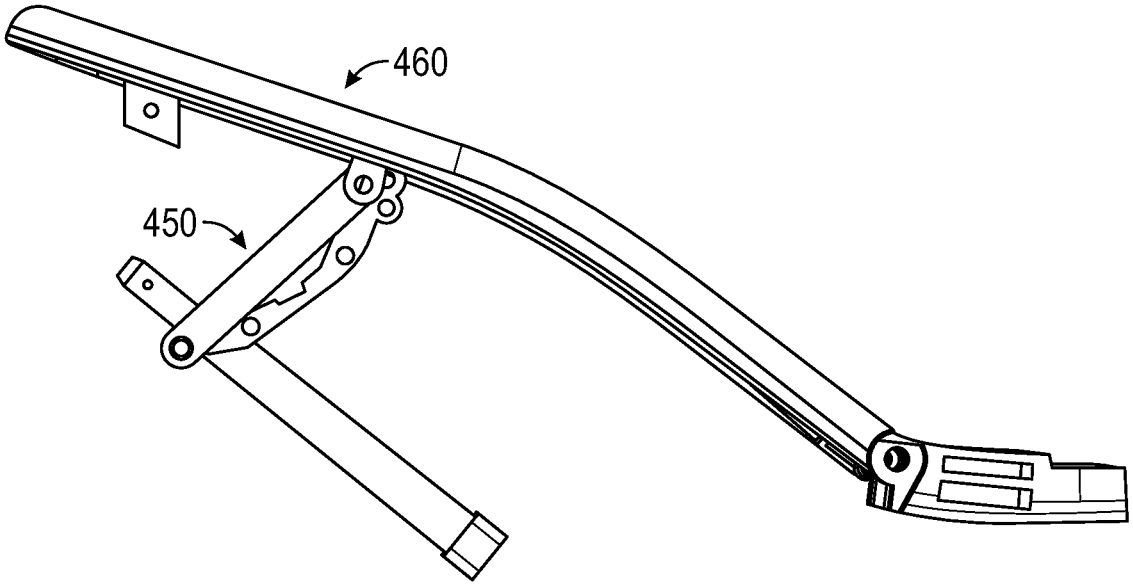
FIG. 3B is a bottom perspective view of an embodiment of a convertible high heel and flat shoe, with certain portions not shown for clarity, and a heel cover piece shown hingeably attached to the heel.

FIGS. 3A, 3B illustrate a heel cover piece 450 hingeably attached to a heel section 460. The heel cover piece 450 is a solid body that is also used as a second linkage. The heel cover piece 450 covers the short heel section 460 in the flat mode/configuration and creates the look of a traditional heel. The heel has two parts: a heel cap/cover piece 450 that covers the short heel and then a tall piece that holds a rod/or support structure. The "triangle support" linkage may or may not be visible on the inside of the heel.

Figure 4:
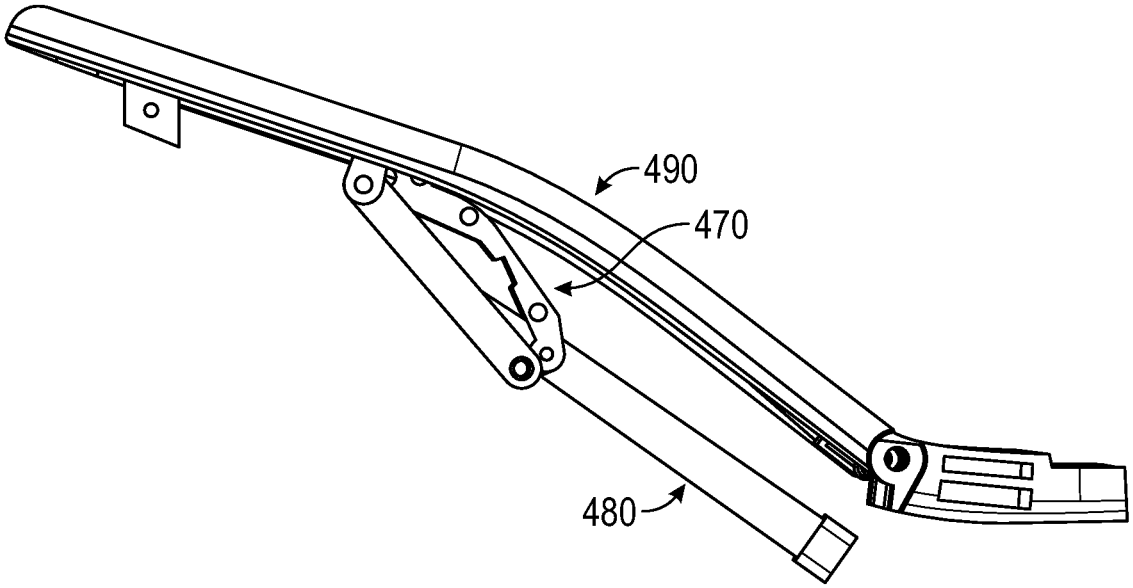
FIG. 4 is a front elevational view of an embodiment of a convertible high heel and flat shoe, with certain portions not shown for clarity, and a guiding linkage mechanism shown guiding the high heel piece towards a receiving section of a sole.
Figure 5:
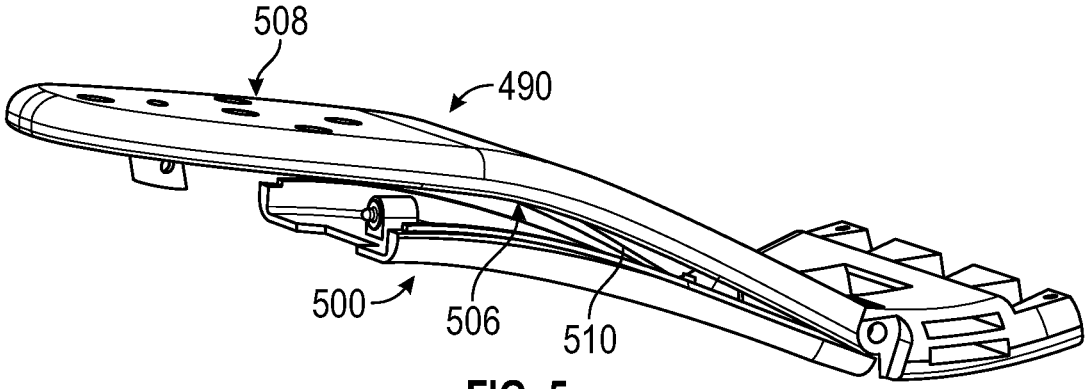
FIG. 5 is a rear perspective view of an embodiment of a convertible high heel and flat shoe, with certain portions not shown for clarity, and a sole cover that covers a high heel piece receiving section shown slightly retraced from a sole.

With reference to FIG. 4 and FIG. 5, a second linkage 470 guides movement of high heel piece 480 into a crevice or receiving section 510 of sole 490. A plastic sole cover 500 unfastens from sole 490, revealing receiving section/crevice 510 in the insole, that high heel piece 480 fits into. The sole cover 500 has a hinge point and uses a ball lock and spring (e.g., spring loaded, with a regular or compliant spring, biasing the sole cover 500 into the closed and/or open position) to hold it locked and unlocked. The openable/partially removable sole cover 500 extends around the sides or inside the sole 490 to create a seal/waterproof seal. The sole cover 500 is unlocked by the user pulling it downward directly or via a tab, squeezing the sides, or unlatching a lock. Additional fasteners that may be used to detachably attached sole cover 500 to sole 490 include Velcro, magnets, elastic, and snaps. In the flat configuration/mode, the sole cover 500 adheres/fastens to insole 506, covering the sole 490 up to the heal section 508, enabling the shoe to be functional as a flat shoe. Leather or fabric covers up all mechanical components to look indistinguishable from a traditional high heel shoe. Around the crevice 510, the insole 506 has rib structures for weight load support. In alternative embodiments, the high heel and flat shoe does not have a receiving section or crevice. In further embodiments of the sole cover 500, the sole cover 500 includes a zipper down the center of the sole 490 or on the sides of the sole 490 for opening and revealing the crevice 510 for the heel to fit in.

Figure 6:
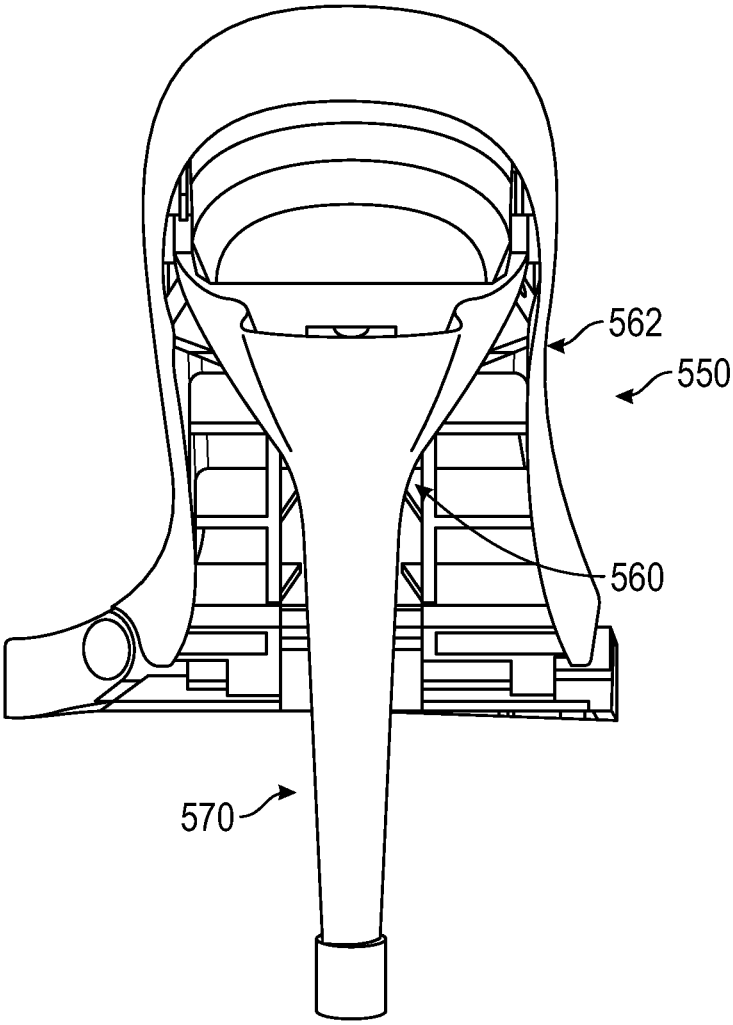
FIG. 6 is a rear elevational view of an embodiment of a convertible high heel and flat shoe, with certain portions not shown for clarity, and a high heel piece receiving section or crevice shown in a sole.

FIG. 6 illustrates an embodiment of a convertible high heel and flat shoe 550 with a high heel piece receiving section or crevice 560 shown in a sole 562 for receiving retractable high heel piece 570 and a heel cover piece for a stationary shorter heel. The heel may have collapsible sides (rubber, fabric, leather, etc.) as shown that fold in one or more ways.

Figure 7A:
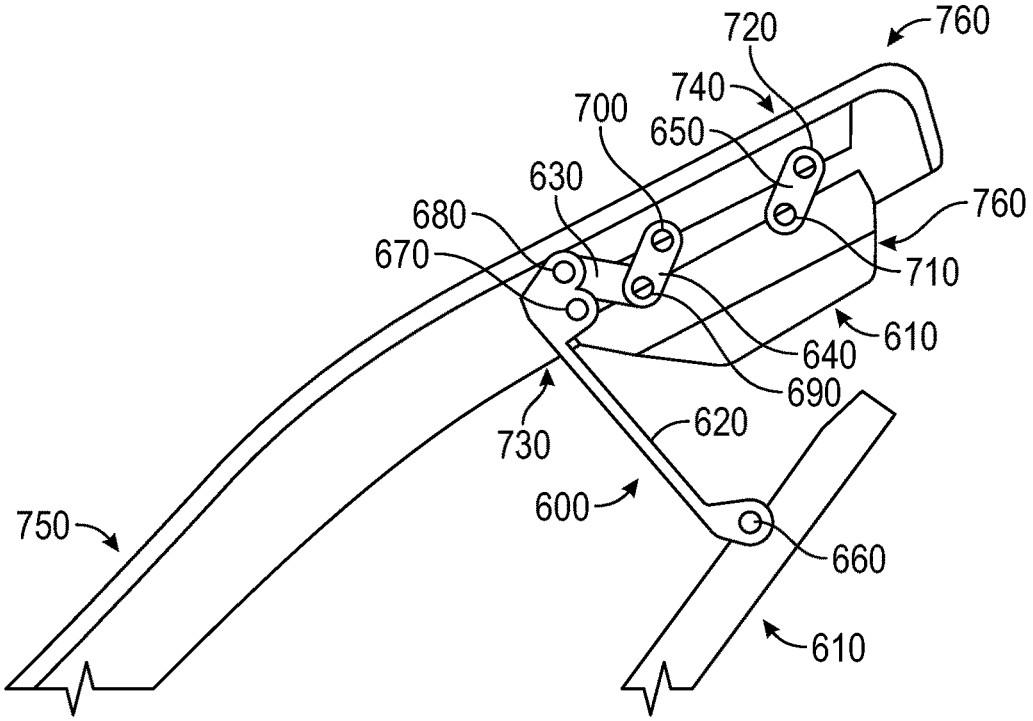
FIG. 7A is a partial side elevational view of the convertible high heel and flat shoe of FIG. 1A, and illustrates an embodiment of a linkage mechanism that moves a shorter heel forward/rearward with movement of the high heel piece.

FIG. 7A illustrates an embodiment of a linkage mechanism 600 that moves a shorter heel forward/rearward with movement of high heel piece 610. The linkage mechanism 600 includes first linkage 620, second linkage 630, third linkage 640, fourth linkage 650, and pivot points 660, 670, 680, 690, 700, 710, 720. The first linkage 620 links the high heel piece 610 to a front 730 of heel section 740. The first linkage 620 is pivotally/hingeably connected to the front 730 of the heel section 740 at pivot point 670 whereby pivoting of the high heel piece 610 into the crevice of sole 750 urges short heel member/cap rearward beneath a bottom of a rear 760 of the heel section 740. Conversely, pivoting/retracting of the high heel piece 610 from the crevice of the sole 750 back towards the heel section 740 urges short heel member/cap 760 forward towards and below the front 730 of the heel section 740. Thus, pivot motion of the high heel piece 610 moving towards the sole 750 engages attached linkage mechanism 600 to rotate and push the shorter heel member/cap downwards and back towards a rear 760 of the heel section 740.

Figure 7B:
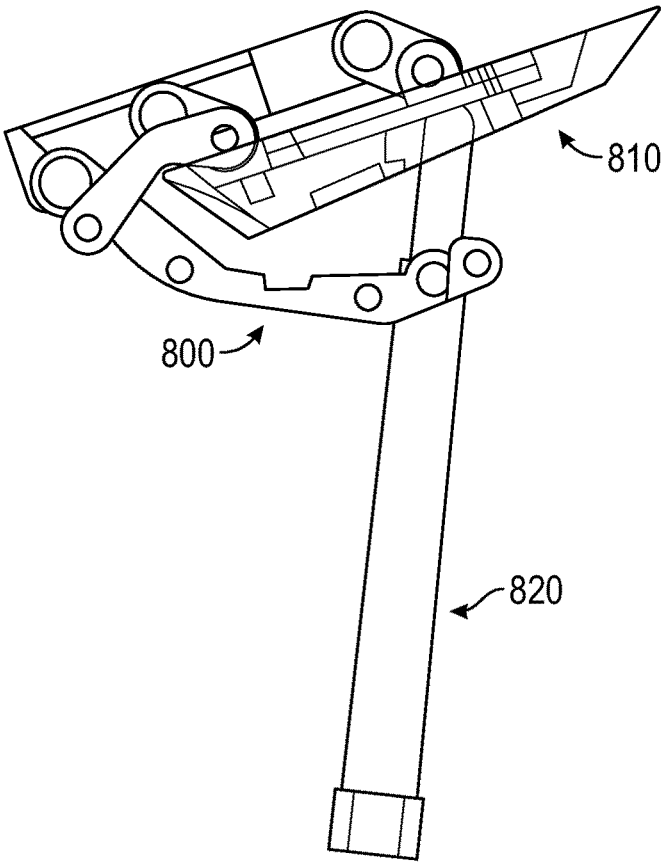
FIG. 7B is a side elevational view of an embodiment of a linkage mechanism that moves a shorter heel forward/rearward with movement of the high heel piece.

FIG. 7B illustrates another embodiment of a linkage mechanism 800 that moves a shorter heel/cap 810 forward/rearward with movement of high heel piece 820.

Figure 7C:
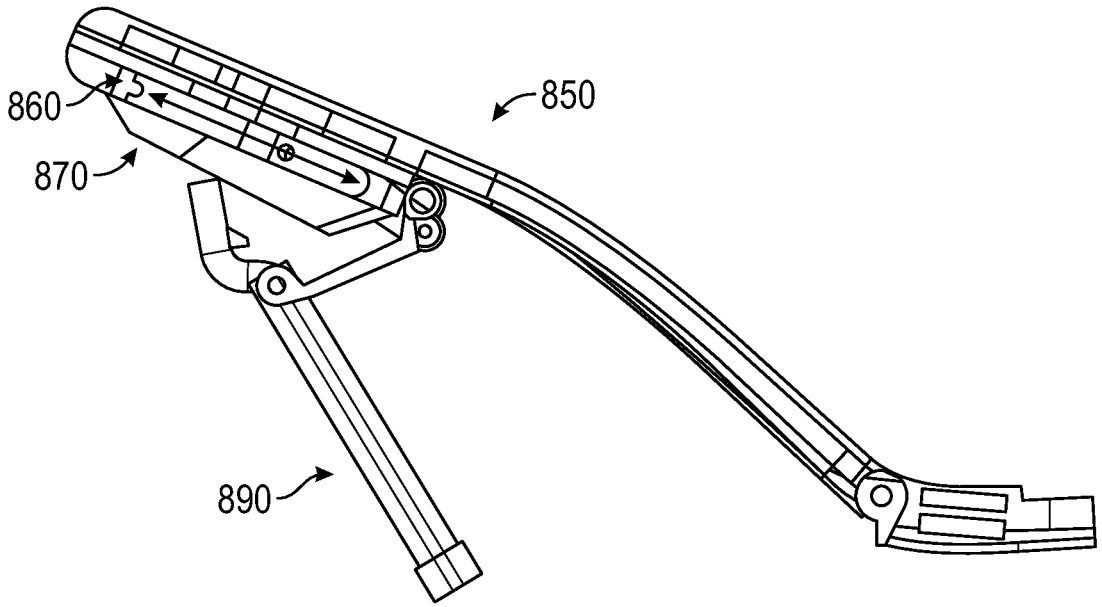
FIG. 7C is a side elevational view of an embodiment of a convertible high heel and flat shoe, with certain portions not shown for clarity, and illustrates an embodiment of a sliding mechanism that allows a heel to move forward/rearward in a linear sliding fashion.

FIG. 7C is an embodiment of a convertible high heel and flat shoe 850 with a linear sliding mechanism 860 that allows a shorter heel/cap 870 to move forward/rearward in a linear sliding fashion via linear slider mechanism 860. Pivot motion of high heel piece 890 pushes or imparts motion of shorter heel/cap 870 heel directly back and forth on a linear slide with the linear sliding mechanism 860.

Figure 8A:
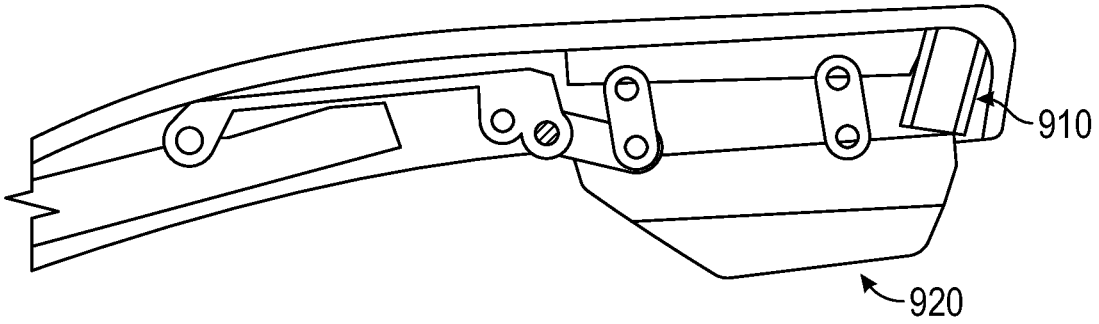
FIG. 8A is a partial side elevational view of the convertible high heel and flat shoe of FIG. 1A, similar to FIG. 7A, and illustrates the linkage mechanism and the shorter heel of FIG. 7A with the shorter heel moved rearward, covering a tube for receiving a high heel piece.

FIG. 8A an embodiment where when a shorter heel member/cap 900 is moved rearward, the shorter heel member/cap 900 covers a cap tube 910 for receiving a high heel piece.

Figure 8B:
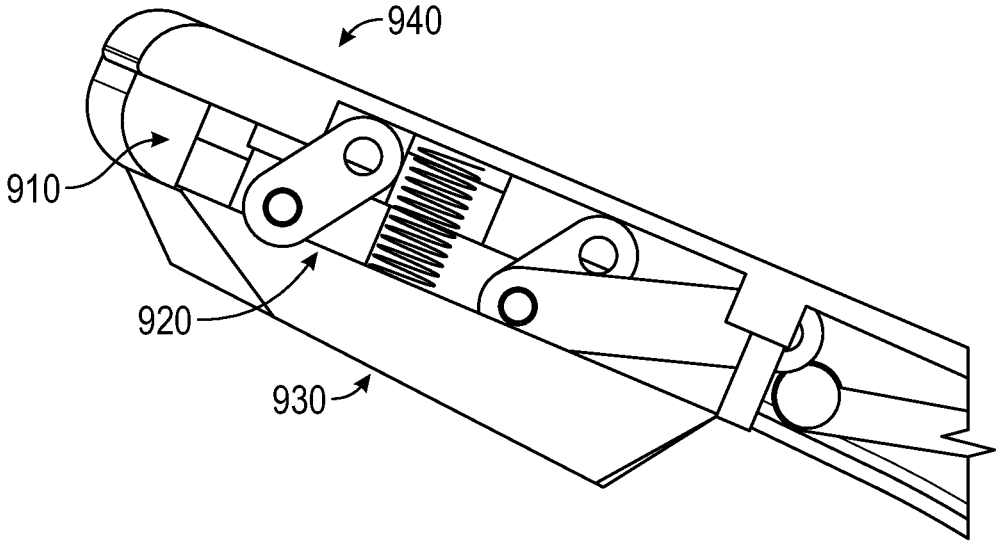
FIG. 8B is a partial side elevational view of a heal section of a convertible high heel and flat shoe, and illustrates an actuated slide wedge between a heel and a sole to help distribute weight load, and illustrates optional spring(s) to control movement of a shorter heel.

FIG. 8B illustrates an embodiment of an actuated slide wedge 920 disposed between a shorter heel member/cap 930 and a heel section 940 to help distribute weight load, and illustrates optional spring(s) 950 to control movement of the shorter heel member/cap 930.

Figure 9A:
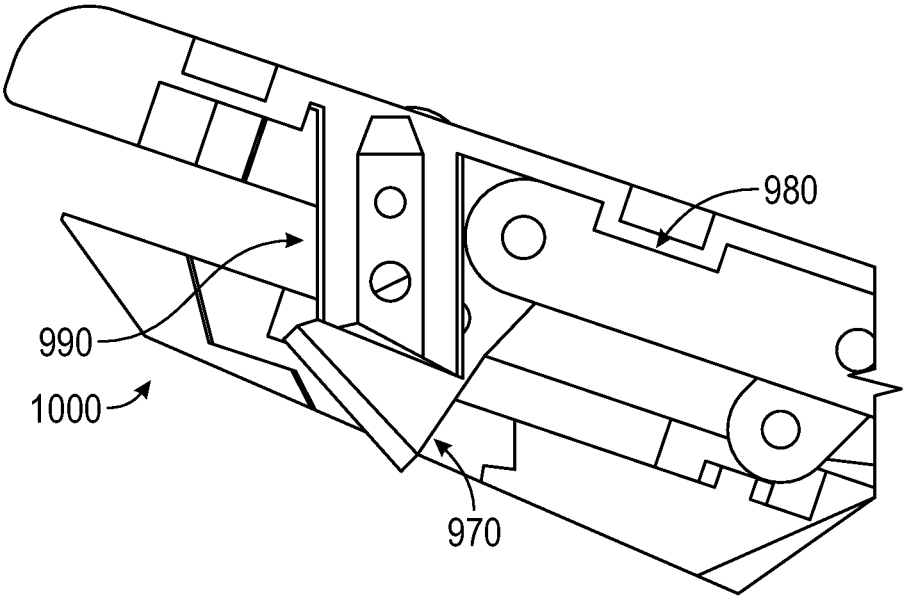
FIG. 9A is a partial side elevational view of an embodiment of a heal section of a convertible high heel and flat shoe, and illustrates a linkage covering a tube for receiving a high heel piece.

FIG. 9A is an embodiment of a linkage 970 of a linkage mechanism 980 configured to cover a cap tube 990 for receiving a high heel piece when a shorter heel member/cap 930 is moved rearward relative to heel section 1000 when the high heel piece is not in use (e.g., in flat configuration/mode).

Figure 9B:
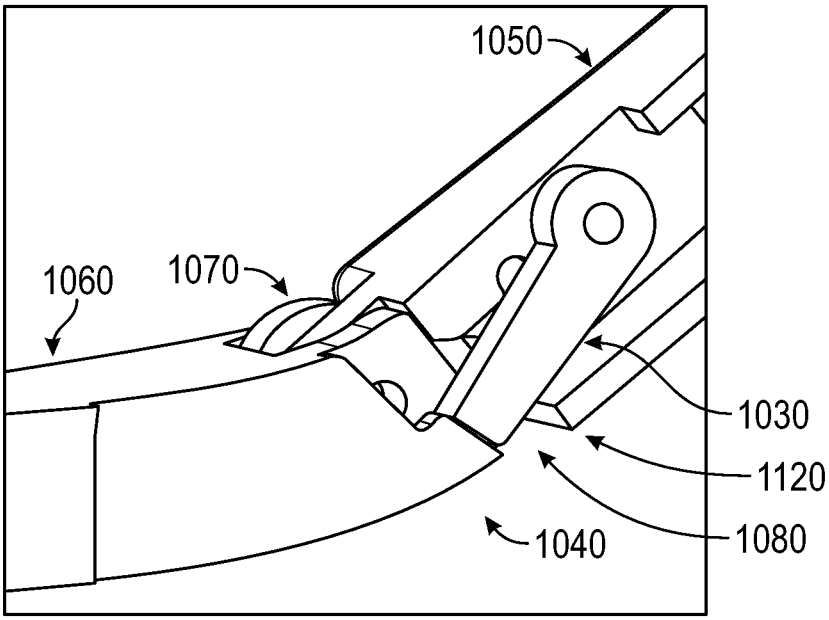
FIG. 9B is perspective view of an embodiment of a latch locking mechanism in a ball or other area of a convertible high heel and flat shoe to lock and unlock the sole relative to the toe to convert between a high heel configuration and a flat configuration.
Figure 9C:
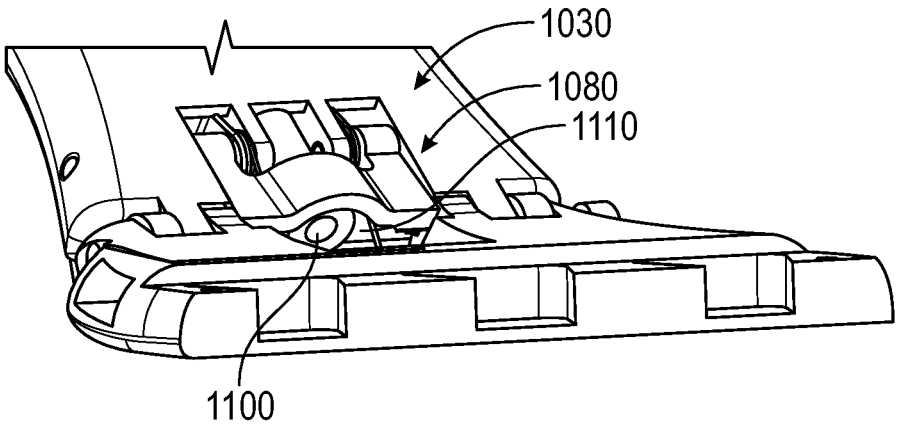
FIG. 9C is another perspective view of the latch locking mechanism of FIG. 9A, and illustrates how receipt of the high heel piece in the sole crevice disengages the latch locking mechanism.

FIGS. 9B, 9C illustrate an embodiment of a latch locking mechanism 1030 in a ball 1040 or other area to lock and unlock a sole 1050 relative to a toe 1060 to convert between a high heel configuration/mode and a flat configuration/mode. A hinge 1070 at the ball 1040 or other area is locked in high heel configuration/mode and unlocked in flat configuration/mode. The latch locking mechanism 1030 includes a latch 1080 with a spring 1090 that urges the latch 1080 to be in a locked position, preventing the hinge 1070 from moving. When high heel piece 1100 is retracted into crevice 1110, the high heel piece 1100 going into the crevice 1100 pushes the latch 1080 upward, releasing the latch 1080 and causing the hinge 1070 to unlock and the entire shoe to become flat. Notches 1120 prevent over travel.

Figure 9D:
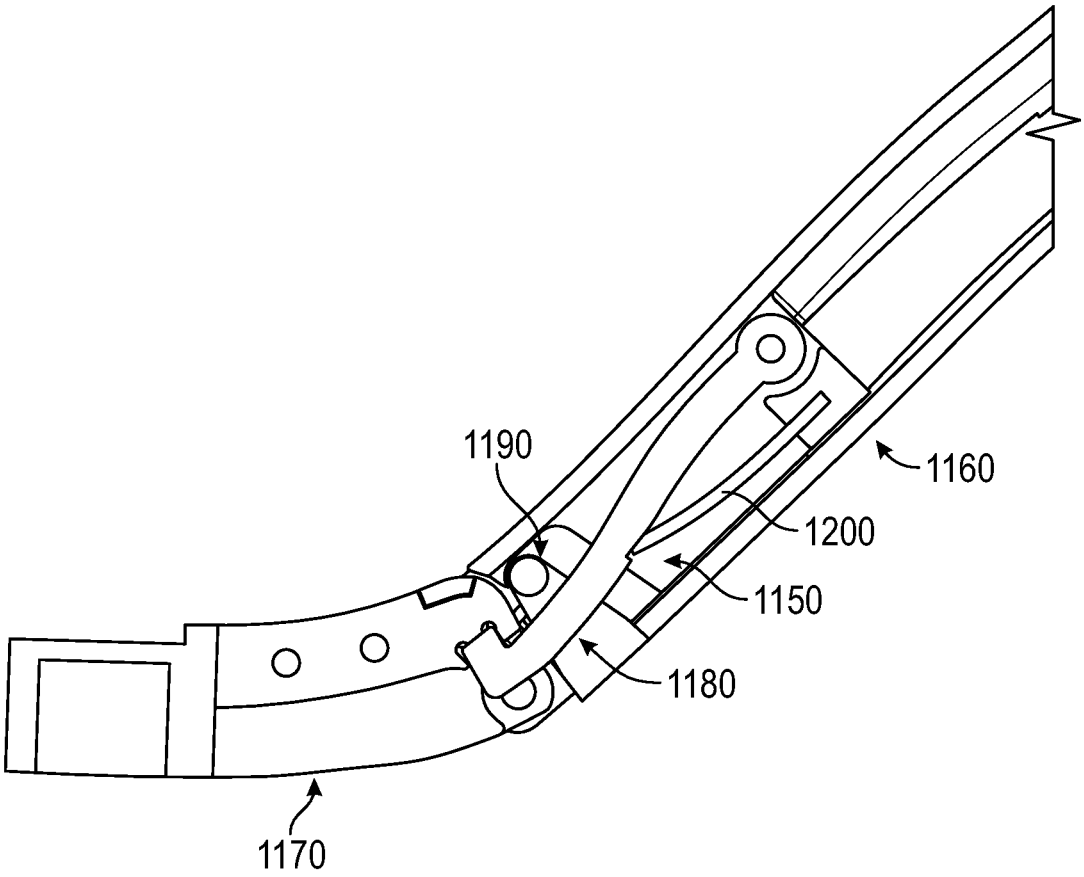
FIG. 9D illustrates an embodiment of a sole releasing latch locking mechanism of a convertible high heel and flat shoe to lock and unlock the sole relative to the toe to convert between a high heel configuration and a flat configuration.

FIG. 9D illustrates an embodiment of a sole releasing latch locking mechanism 1150 to lock and unlock a sole 1160 relative to a toe 1170 to convert between a high heel configuration/mode and a flat configuration/mode. In this embodiment, the sole 1160 opening and closing actuates latch 1180 unlocking and locking. The sole 1160 is connected to the latch 1180 with elastic, a spring, or latch catch member 1190 and pulls the latch 1180 downward when opening of the sole 1160 while spring 1200 urges the latch 1180 upward. In flat configuration/mode, the high heel piece inside the crevice in the sole 1160 prevents the sole 1160 from accidentally locking into high heel configuration/mode.

Figure 10:
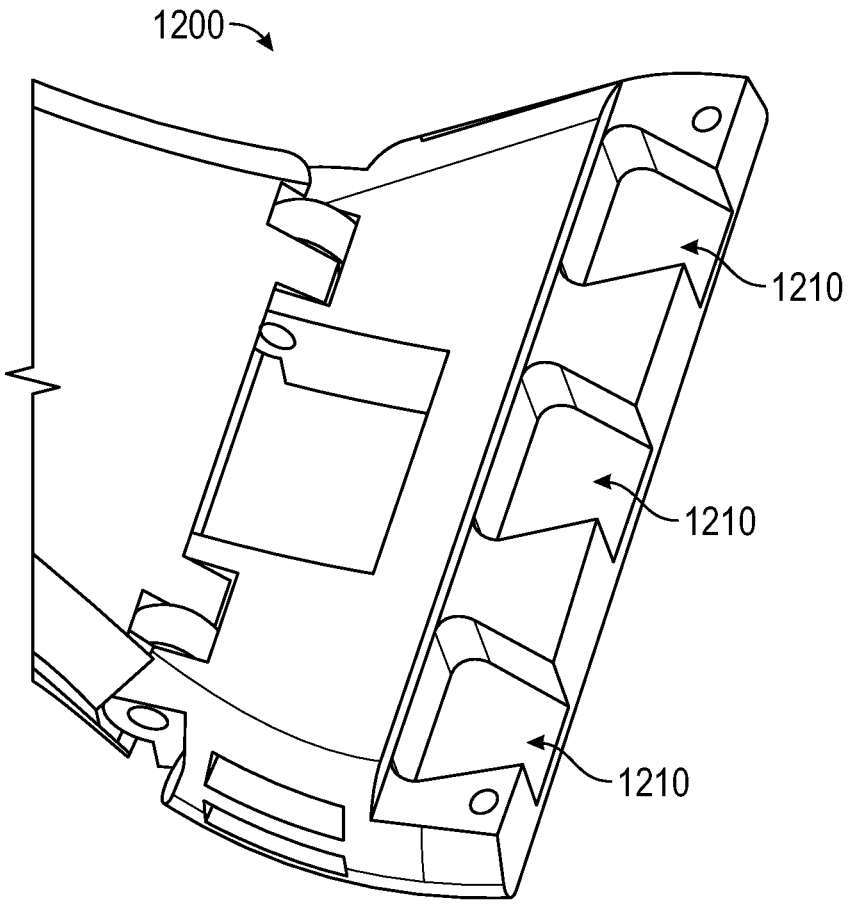
FIG. 10 illustrates a partial perspective view of a sole piece of a convertible high heel and flat shoe.

FIG. 10 illustrates a partial perspective view of a sole piece 1200 of a convertible high heel and flat shoe. The sole piece 1200 has indents to hold foam or flexible material for comfort.

Important aspect of the convertible high heel and flat shoe include a shorter heel member/cap concealed by a high heel/piece, the short heel member/cap may move forward and back to become smaller or cover up open spaces where needed, high heel includes a triangle shape for weigh load structure and stability, high heel has material that can collapse to be flatter, the high heel is locked into the back, heel section of the sole, the high heel uses a movable top lift (or a pull to release motion) to release the lock, the midsole locks in at least one position at the ball or other area of the foot, and the sole can be released to cover and uncover the high heel.

With reference to FIGS. 11-34, embodiment(s) of a convertible high heel and flat shoe ("shoe") 1300 that is convertible between a high heel shoe configuration and a flat shoe configuration will be described. The shoe 1300 solves the problem of uncomfortable high heel shoes by giving a user the option to convert one's heels to a flat when the shoes inevitably become painful. The shoe 1300 is great for commuting or anytime one wants the advantage of both a heel and a flat shoe.

Figure 11:
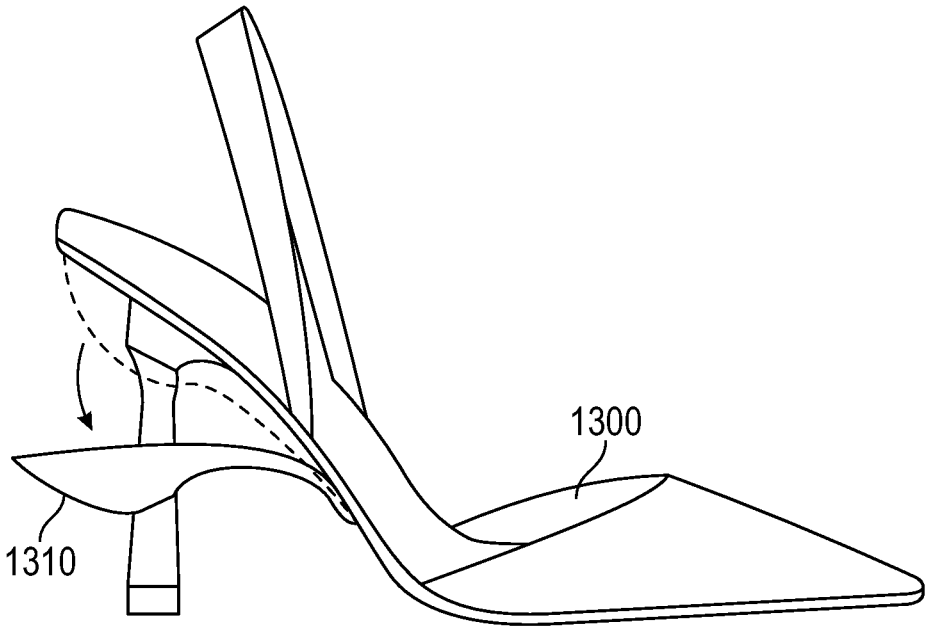
FIG. 11 is a side elevational view of an embodiment of a convertible high heel and flat shoe, and shows the sole opening to reveal inside mechanical components.

The shoe 1300 converts to a flat by following these steps:

The shoe 1300 has an openable sole or covering component 1310 that is hingeably connected and/or flexible (FIG. 11). To convert to a flat, the sole 1310 is opened or removed, revealing and making accessible the heel mechanical components.

Figure 12:
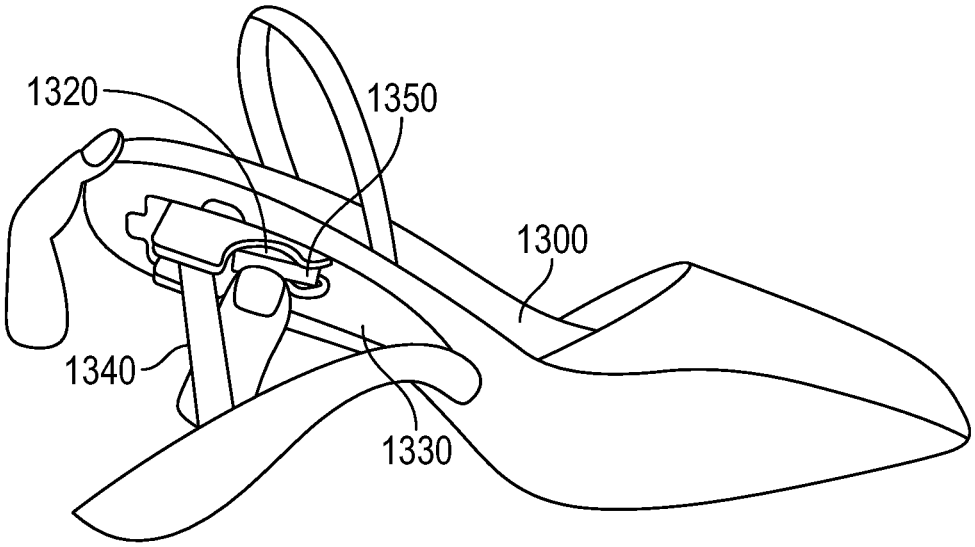
FIG. 12 is a bottom perspective view of the convertible high heel and flat shoe of FIG. 1, and shows the pushing of a button to release the heel.
Figure 13:
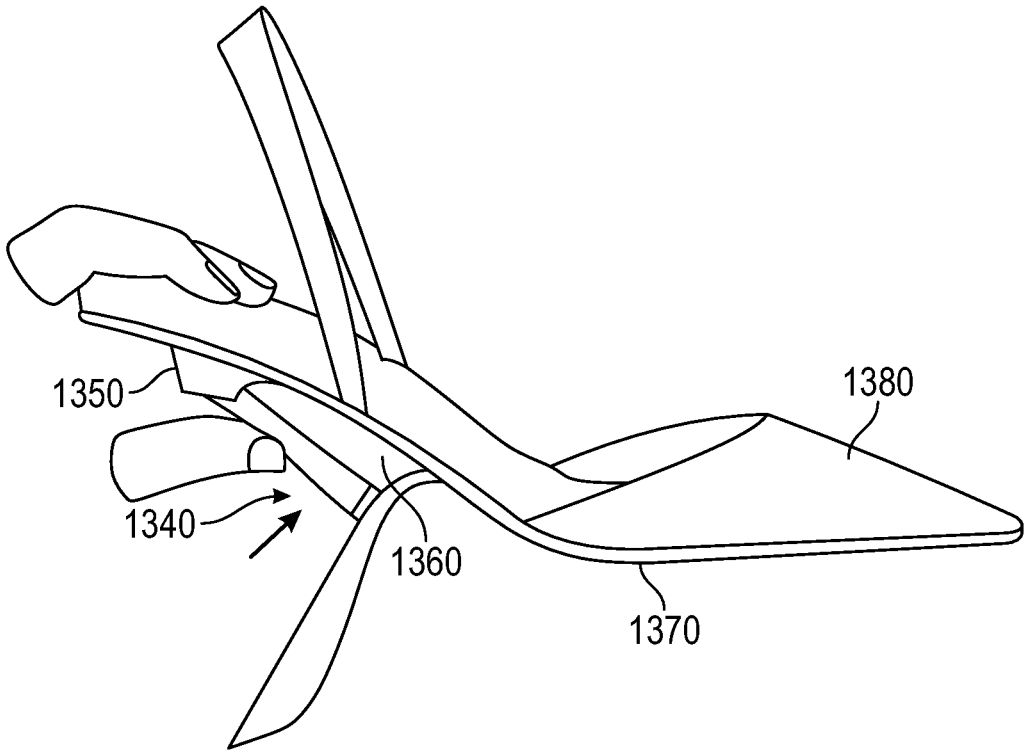
FIG. 13 is a side elevational view of the convertible high heel and flat shoe of FIG. 1, and shows the heel folding into the sole of the shoe.

A button 1320 is pushed on an inside 1330 of the shoe 1300 to release heel 1340 (FIG. 12). This button 1320 is held on a pivot 1350 that is spring-loaded. When pushed, the heel 1340 can fold freely. The heel 1340 is then guided/pushed inwards on the pivot 1350 and folded into an opening or crevice 1360 in sole 1370 of the shoe 1380 (FIG. 13).

Figure 14:
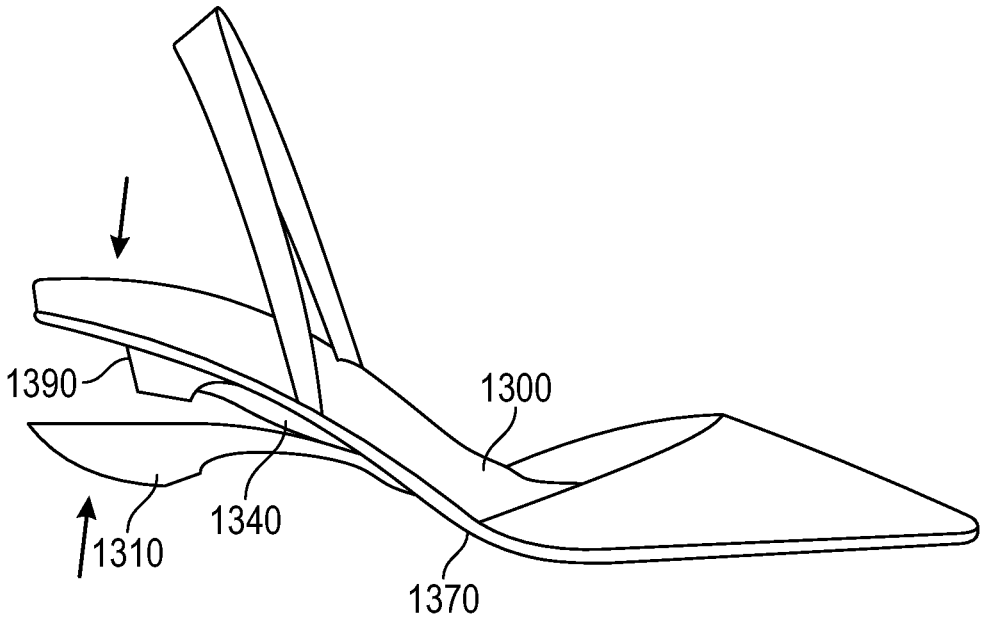
FIG. 14 is a side elevational view of the convertible high heel and flat shoe of FIG. 1, and shows the sole closing to cover components.

The sole/cover 1310 is then closed to cover the heel 1340 and mechanical components (FIG. 14). The sole 1310 is then fastened to the shoe 1300 and now the shoe 1300 is walk-able as a flat.

To transform the shoe 1300 back into a heel, the sole cover 1310 is pulled open, the heel 1340 is grabbed out of the sole 1370 of the shoe and guided to a locked position. A lock 1390 automatically clicks in, gripping the heel 1340 tightly in heel mode. The cover 1310 is guided up the heel 1340 and secured closed.

Figure 26:
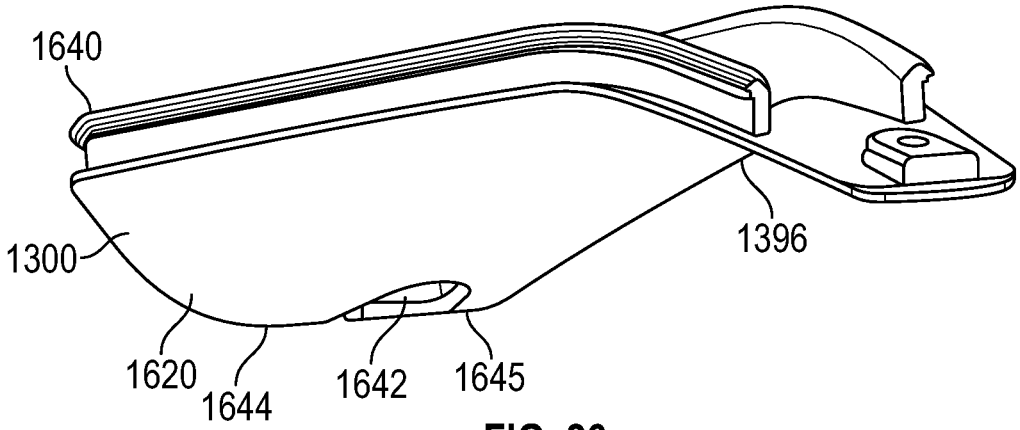
Figure 27:
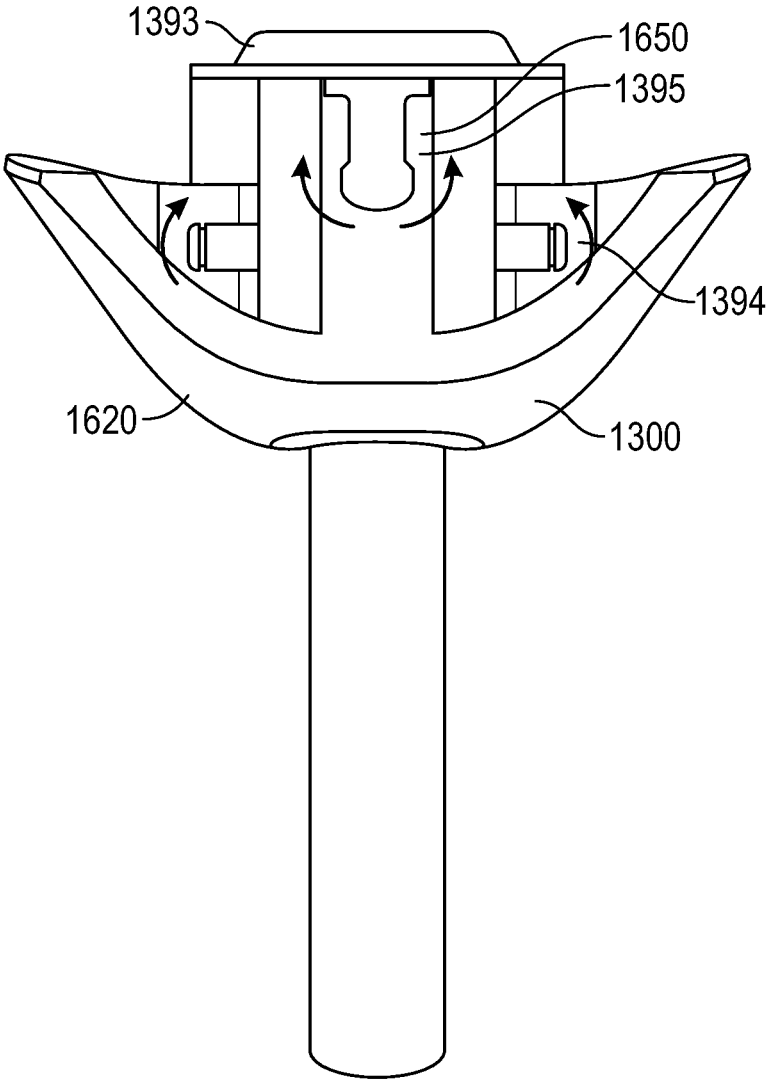
FIG. 27 is an enlarged partial cross-sectional view, showing securing the cover with rods, rivets and semi-flexible components.
Figure 28:
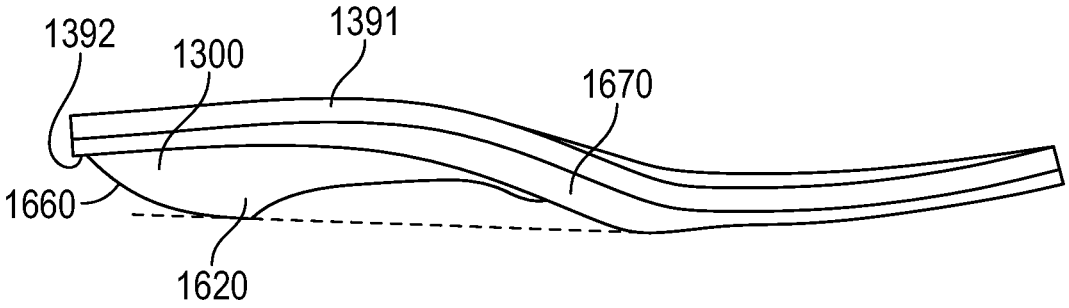
FIG. 28 is a side elevational view of the convertible high heel and flat shoe of FIG. 1, and shows walking on the cover in flat mode.

FIG. 28 shows how the sole cover 1300 is released from shoe body 1391 by an indent 1392. FIG. 27 shows how the sole cover 1300 attaches to heel body 1393 by using a snap fit 1394—with indents/overhangs 1395. FIG. 26 shows how the sole cover 1300 opens and closes via a hinge or the flexibility of its own material 1396 and has a flat area 1644 on bottom 1645 that can be walked on in 'flat mode' of the shoe.

Figure 15:
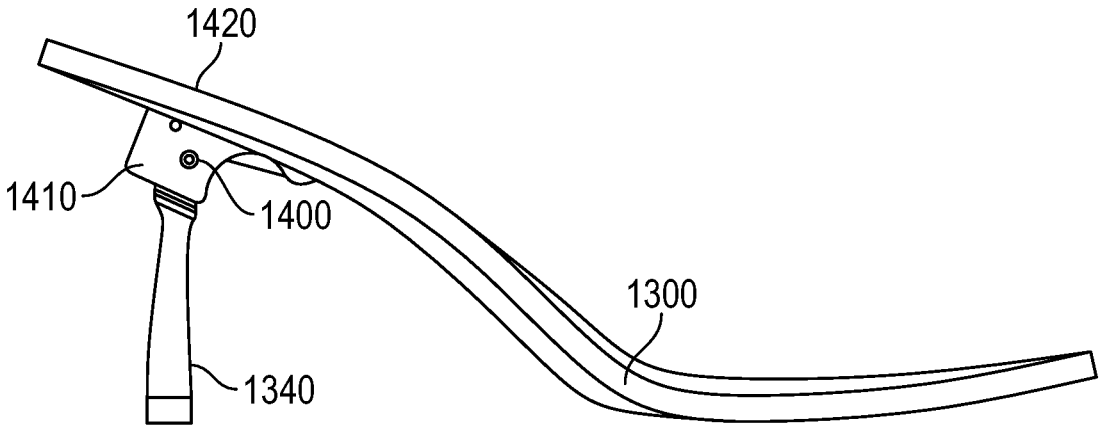
FIG. 15 is a side elevational view of the convertible high heel and flat shoe of FIG. 1, and shows the connection of heel to the shoe with a pivot point.

To create a foldable shoe 1300, the heel 1340 is connected and can move relative to the shoe 1300 by a pivot point 1400. The position of the pivot point 1400 could be in multiple locations on the shoe 1300. Mainly the heel 1340 is hingeably connected to a bracket 1410 and that bracket 1410 is attached to a shank 1420 (FIG. 15).

Figure 16:
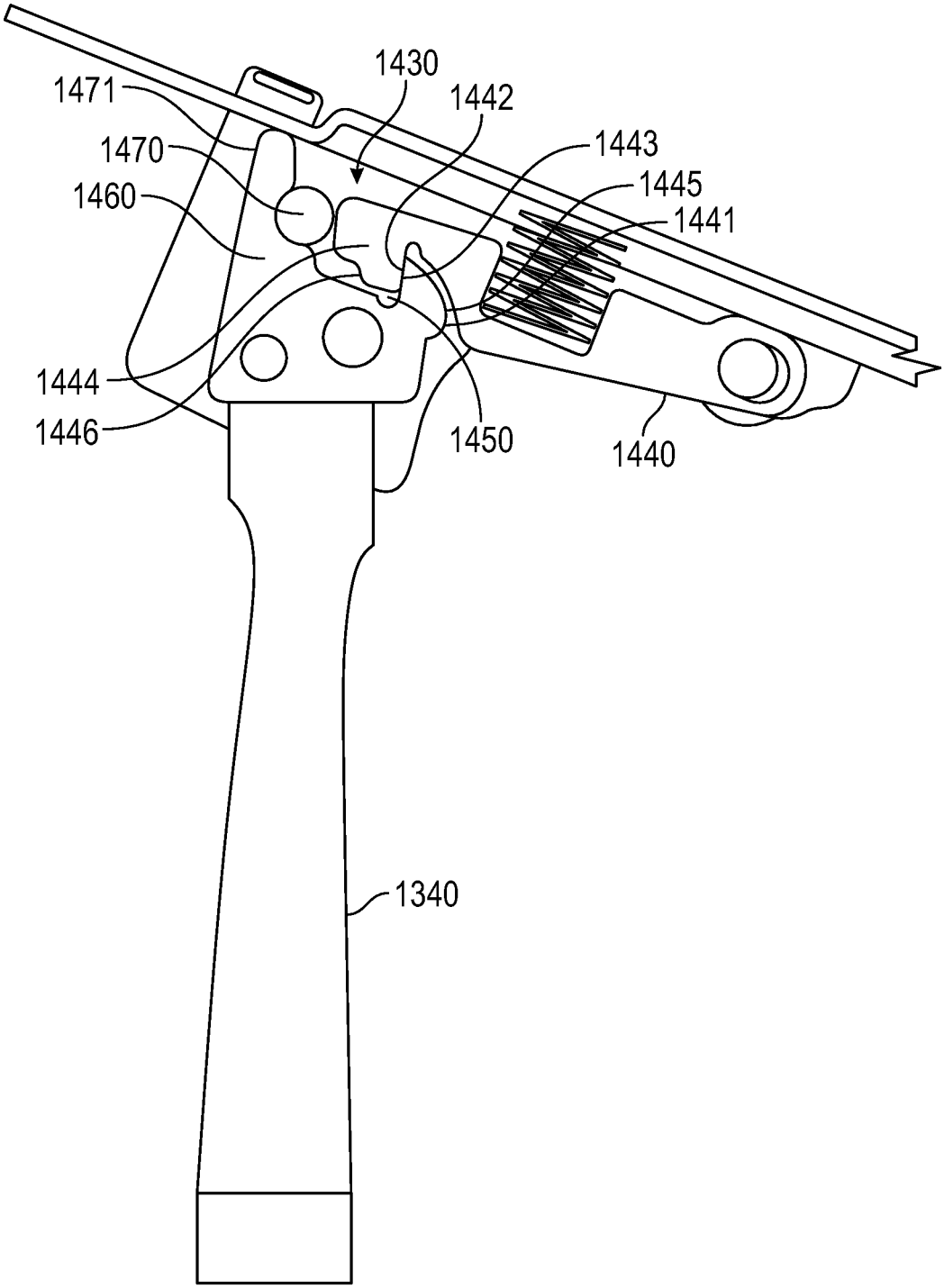
FIG. 16 is an enlarged partial side elevational view of the convertible high heel and flat shoe of FIG. 1, and shows the latch locked in high heel shoe mode by wedging into the heel bracket.
Figure 17:
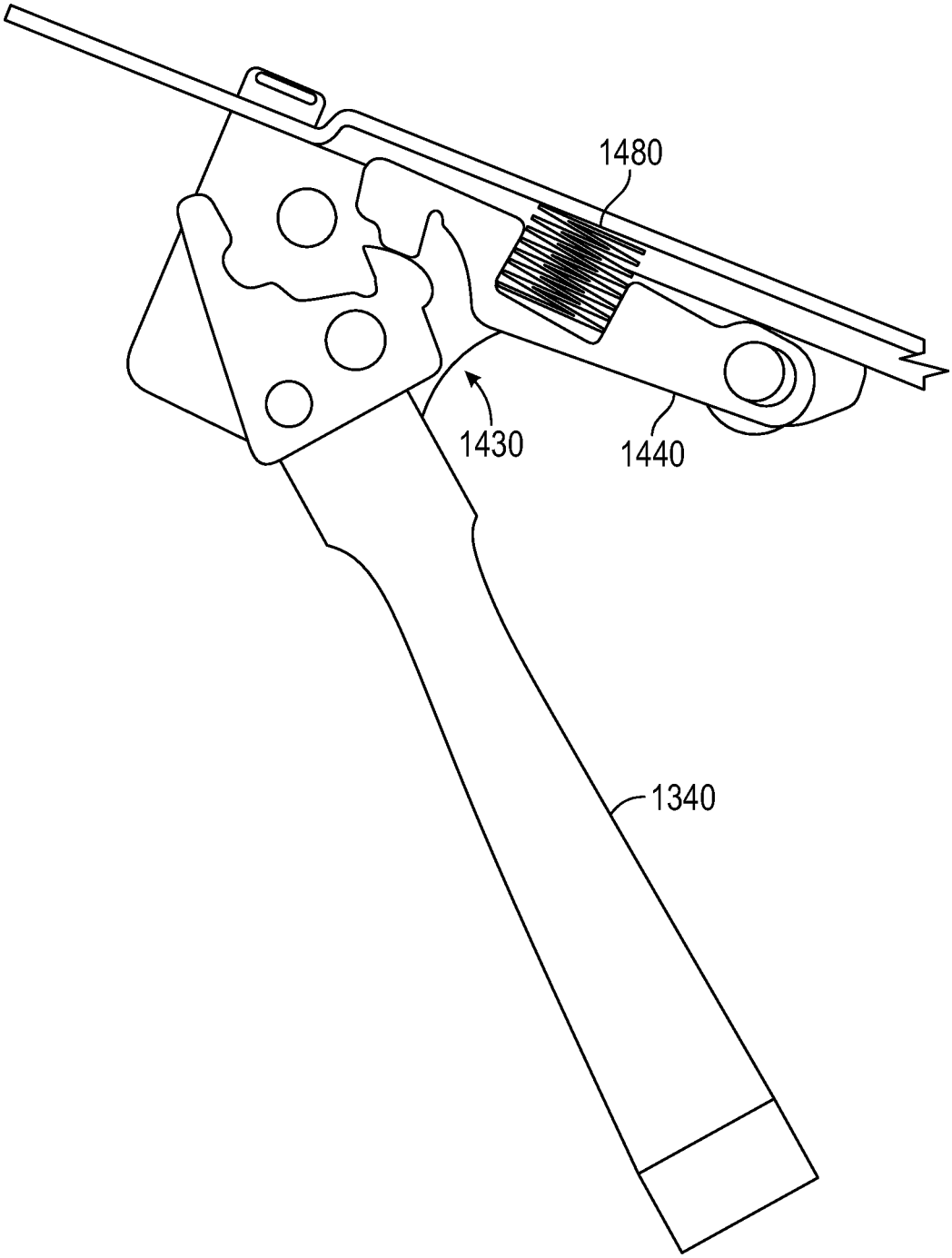
FIG. 17 is an enlarged partial side elevational view of the convertible high heel and flat shoe of FIG. 1, and shows the latch released and that the heel moves relative to the pivot point.
Figure 18:
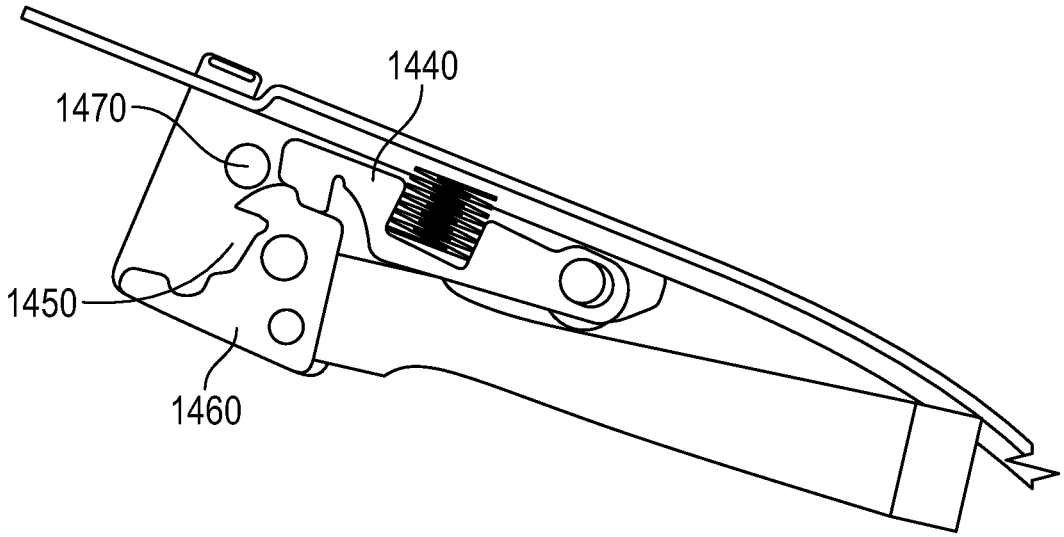
FIG. 18 is an enlarged partial side elevational view of the convertible high heel and flat shoe of FIG. 1, and shows the latch face holding the heel in a flat position.

A locking mechanism 1430 is used to hold the heel 1340 in high heel position. To lock, a latch 1440 wedges into a groove 1450 on a block 1460 of the heel 1340, between a stationary pin 1470 and the heel 1340 (FIG. 16). The stationary pin 1470 is engaged by finger 1471 of block 1460 to limit rearward rotation of the heel 1340. The locking mechanism 1430 is released by pushing on the latch 1440 to move it out of its wedged position and freely move the heel 1340 (FIG. 17).

The latch 1440 is spring loaded to automatically wedge into the correct positions. In heel mode, a spring 1480 is used to force the latch 1440 as deep as possible and prevent any slop or wiggle of the heel 1340. In flat mode, the latch 1440 is used as a stopper to hold it in the flat position with spring force (FIG. 18) and prevent it from rattling around.

A catch 1441 includes a rearward facing portion 1442 that engages with a forward facing forward portion 1443 of latch member 1444 in the heel mode and the catch 1441 includes a forward facing portion 1445 that engages a rearward facing portion 1446 of the latch member 1444 in the flat mode.

Figure 19:
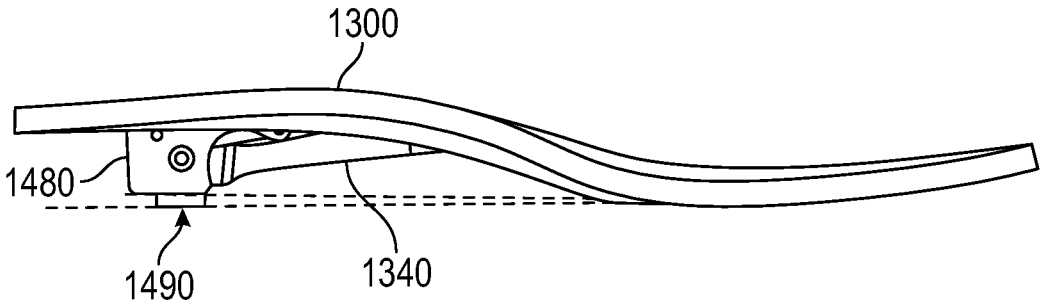
FIG. 19 is a side elevational view of the convertible high heel and flat shoe of FIG. 1, and shows the bracket and the heel block with rubber pad in a flat mode.

Shoe wearers could walk on the side of a heel block (or bracket) 1480 or rubber pad 1490 in flat mode. This is shown in FIG. 19 when the wearer could walk on the metal heel block (or bracket) 1480 in ground plane 1 or walk on the optional rubber pad 1490 on ground plane 2. The heel 1340 is released from flat mode by pulling on the heel 1340 inside the shoe 1300.

Figure 20:
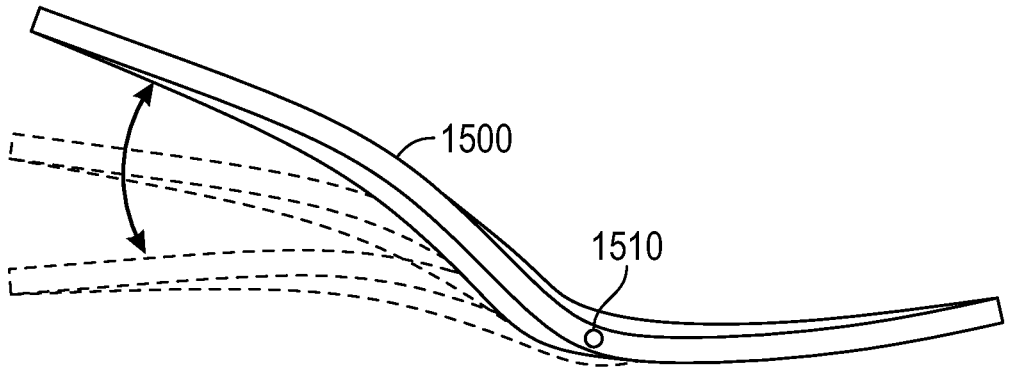
FIG. 20 is a side elevational view of the convertible high heel and flat shoe of FIG. 1, and shows the shoe midsole shape in both heel and flat modes.
Figure 21:
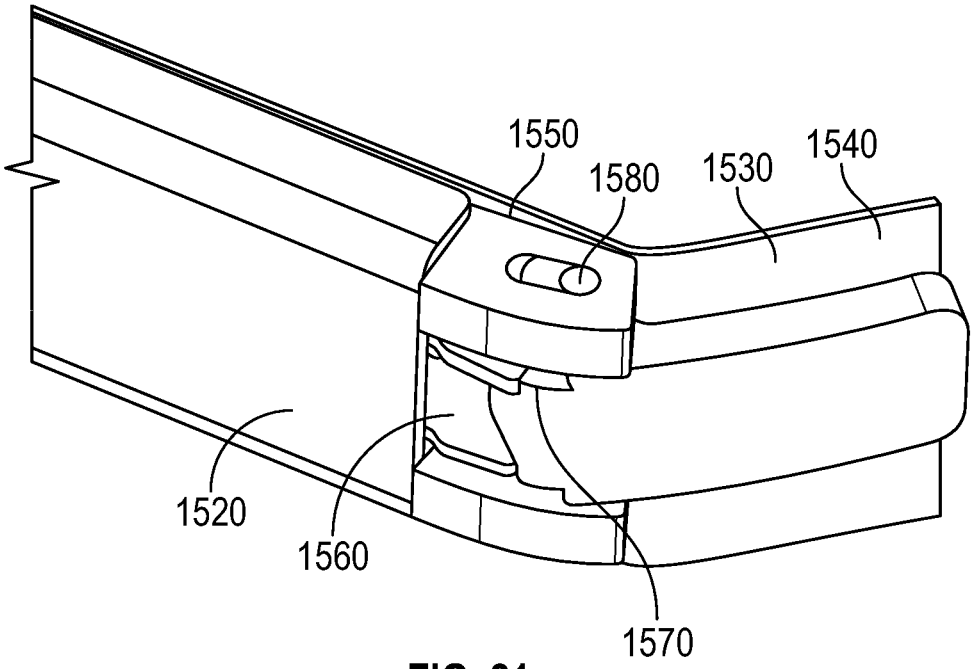
FIG. 21 is an enlarged perspective view of a lock mode, where wedge piece is pushed into the groove.
Figure 22:
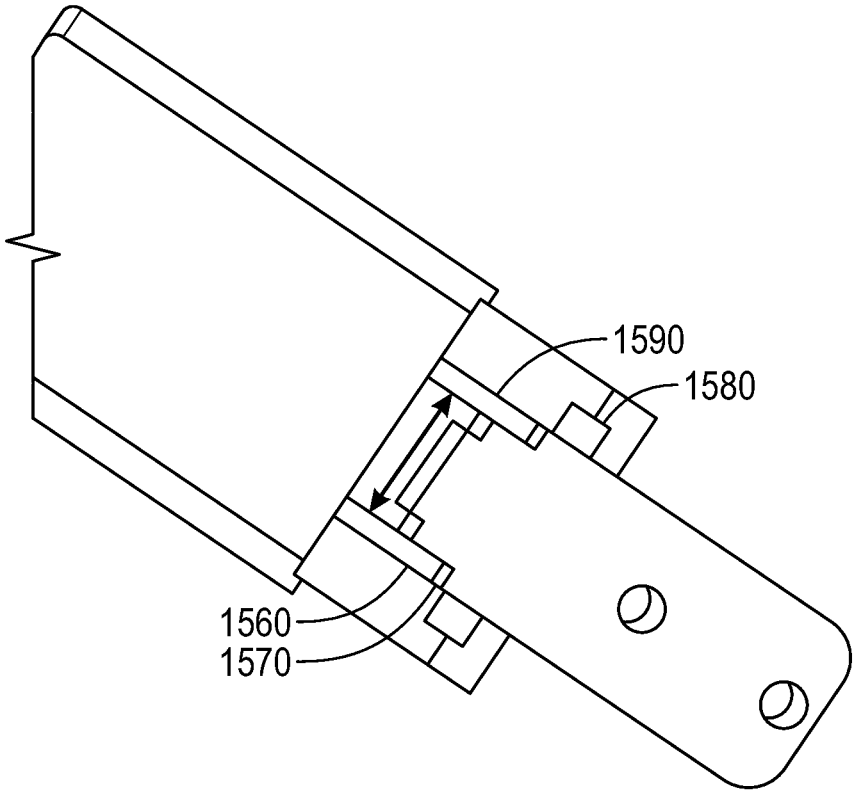
FIG. 22 is an enlarged perspective view of an unlock mode, wedge piece is released from the groove.

The arc and shape of shoe midsole 1500 adapts between heel and flat mode (FIG. 20). A pivot point 1510 changes the shape and there is a lock 1520 at a ball, hinge, or flexure 1530 of foot area 1540 to hold the two positions. In heel mode, the lock 1520 is locked, and, in flat mode, the lock 1520 is opened to flex freely. The lock 1520 is composed of a hinge 1550 and a wedge piece 1560. In lock mode, the wedge piece 1560 uses spring force to push into a groove 1570 on the lock 1520 and prevents it from moving freely (FIG. 21). A rod/notch 1580 also could stop the hinge motion in one direction, the wedge piece 1560 prevents movement in the other direction. To unlock, in flat mode, the wedge piece 1560 is pushed out of the groove 1570 and a hinge 1590 can move (FIG. 22).

Figure 23:
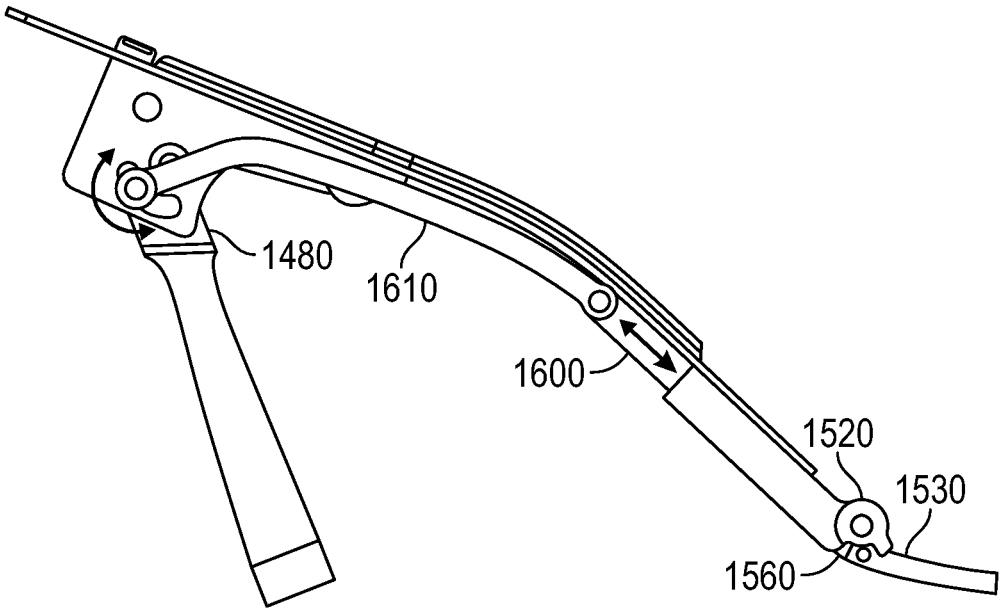
FIG. 23 is a side elevational view of the rotation of the heel block pushing a connector that moves a slider to unlock the ball of the foot lock.
Figure 24:
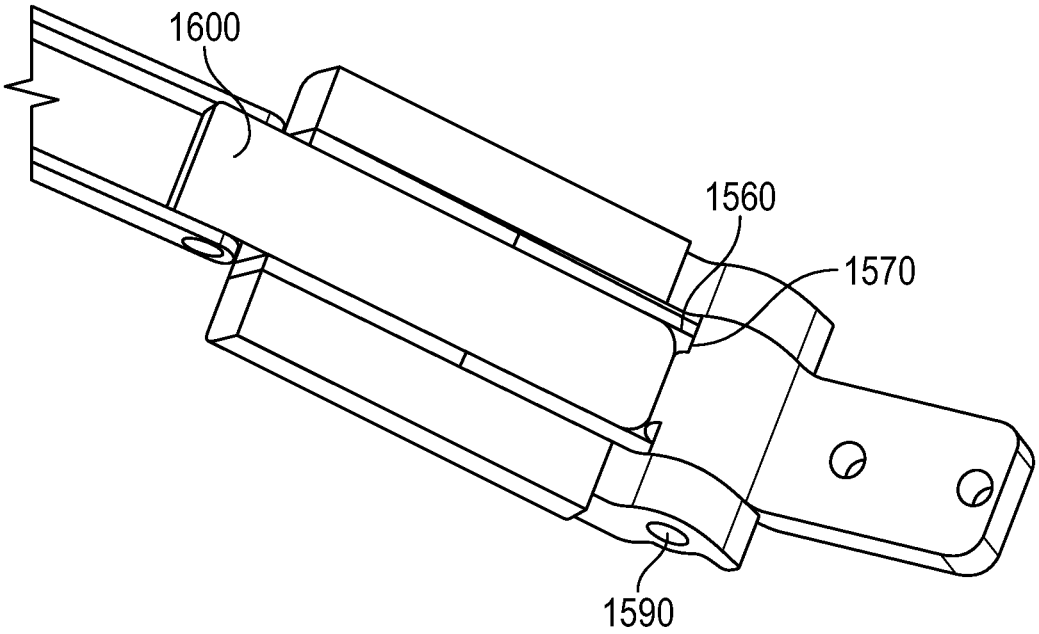
FIG. 24 is an enlarged perspective view of the slider pushing wedge pieces to release the hinge lock.
Figure 25:
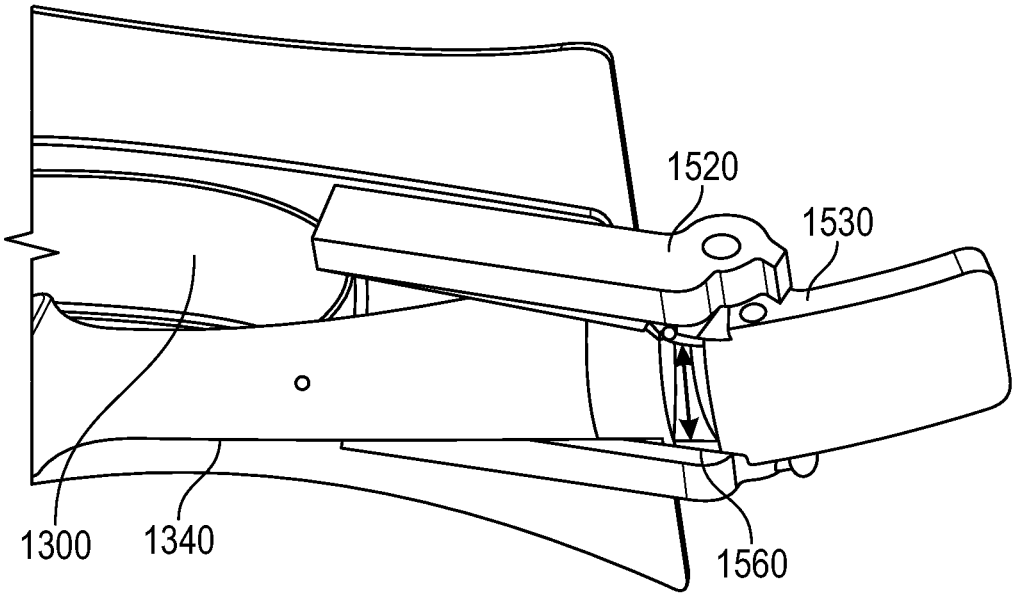
FIG. 25 is an enlarged perspective view of a heel pushing slider to release.

To unlock the hinge or flexure 1530 of the foot lock 1520, a slider 1600 is used to move the wedge piece 1560. The slider 1600 is constrained within lock mechanism 1520 and/or shoe 130, and pushed by a connector 1610, which is hingeably attached to the heel block 1480. As the heel block 1480 rotates, it pushes the connector 1610, which then moves the slider piece 1600 (FIG. 23). When the slider 1600 is moved in the way of the wedge piece 1560, it releases it and the hinge 1590 can move freely (FIG. 24). When the slider 1600 is moved out of the way of the wedge piece 1560, the spring force pushes the wedge piece 1560 into the groove 1570 and locks it in position.

Another way that the hinge or flexure 1530 of the foot lock 1520 could be released is by using the end of the heel 1340. When the heel 1340 is stored within the shoe 1300, the heel 1340 could push on the wedge piece 1560 (FIG. 25), releasing it from lock mode. When the heel 1340 is removed, the wedge piece 1560 uses spring force to lock itself in position.

To cover mechanical components, a sole or bottom cover piece 1620 is used. This piece 1620 is attached to body 1630 of the shoe 1300 with a hinge, screw, flexible component or mix 1640. The sole or bottom cover piece 1620 travels open and closed to cover and uncover the heel and has a hole 1642 to align the heel 1340 through (FIG. 26). The sole or bottom cover piece 1620 includes a flat area 1644 that can be walked on. The sole or bottom cover piece 1620 is secured by a lock, rod, rivet or semi flexible component 1650 (FIG. 27). The sole or bottom cover piece 1620 could have a ridge 1660 for releasing with a finger. A bottom side 1670 of the sole or bottom cover piece 1620 could be walked on in flat mode (FIG. 28).

Figure 29:
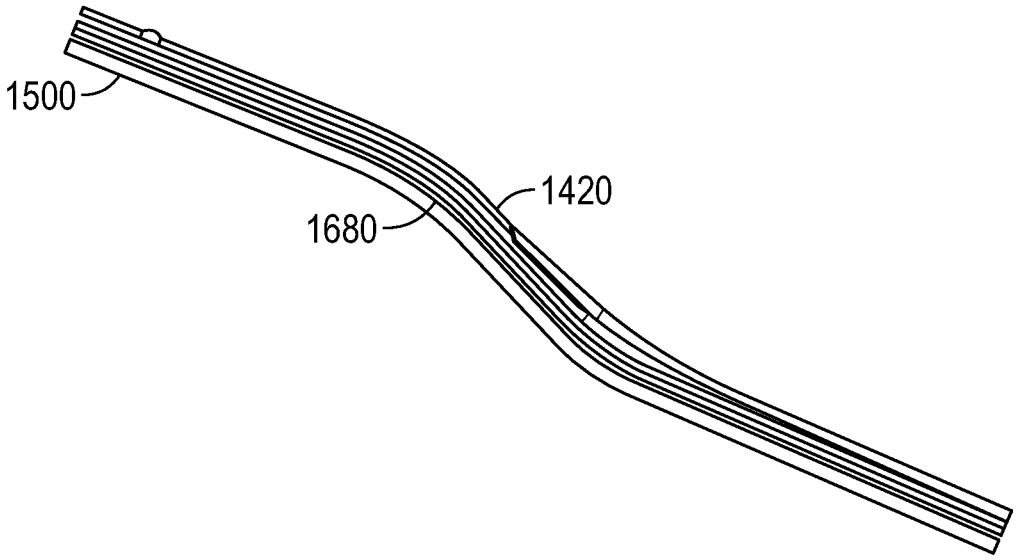
FIG. 29 is a side elevational view of the convertible high heel and flat shoe of FIG. 1, and shows material layers for the insole.
Figure 30:
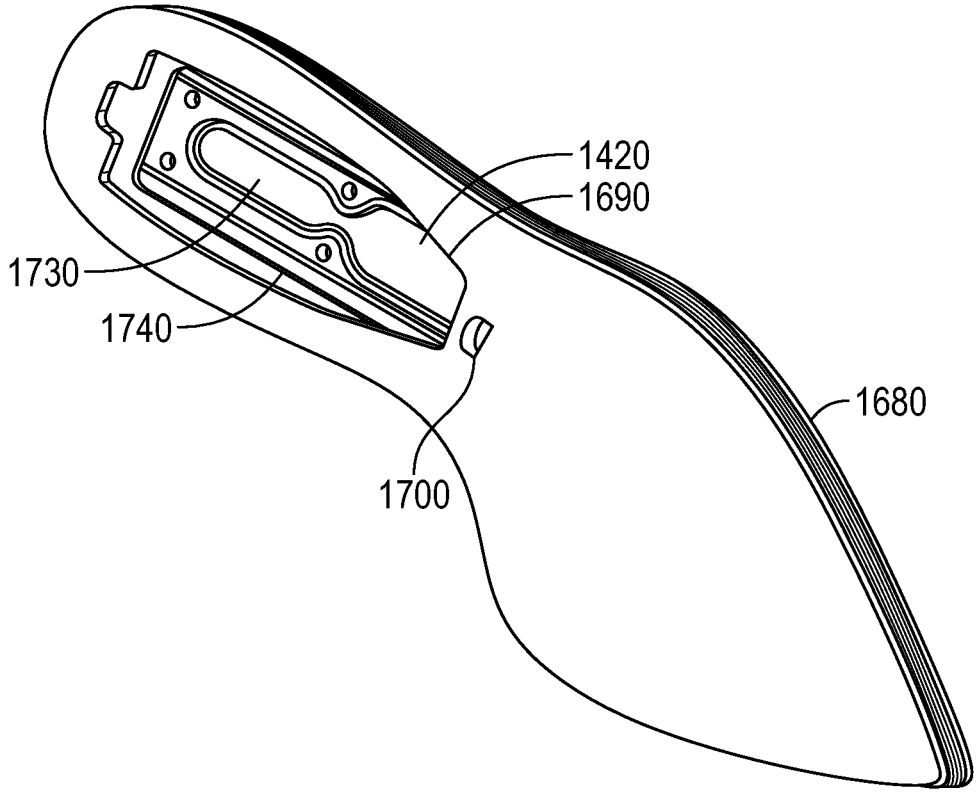
FIG. 30 is a bottom perspective view of the convertible high heel and flat shoe of FIG. 1, and shows material cut outs for mechanical components.
Figure 31:
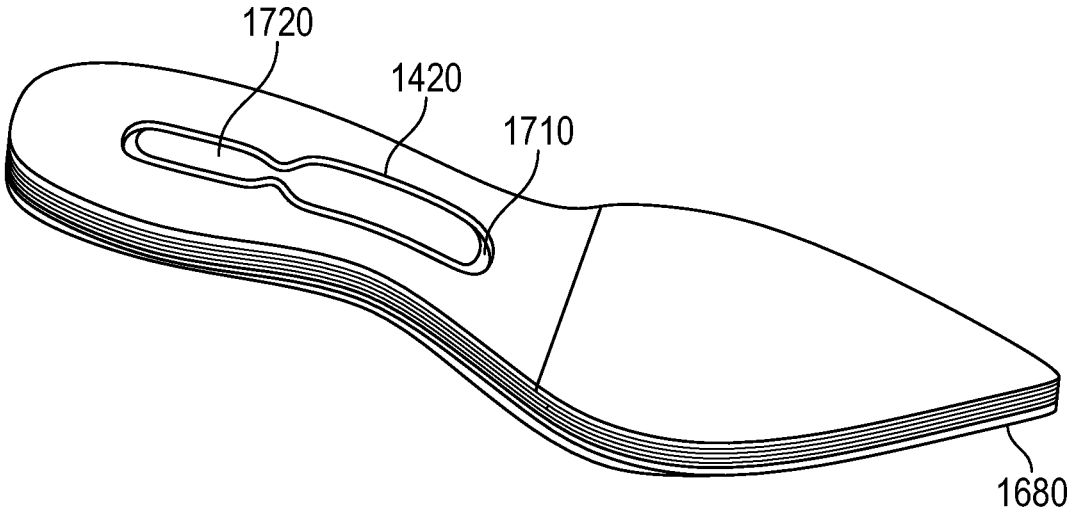
FIG. 31 is a bottom perspective view of the convertible high heel and flat shoe of FIG. 1, and shows indents on shank to fit mechanical components.

The body of the shoe or midsole 1500 is composed by layered materials 1680 and the shank piece 1420. The layers 1680 contain various materials that are a mix of stiff and flexible materials (FIG. 29). The layered composition 1680 includes the shank 1420 and has a cutout 1690 for the mechanical components (heel bracket 1480, heel 1340, hinge or flexure 1530 of foot lock 1520, etc.) and cutouts 1700 for various leather assembly techniques (FIG. 30). The top of the layered composition 1680 has a cutout 1710 to fit a top indent 1720 of the shank 1420 (FIG. 31). A shank indent/rib 1730 strengthens the layers 1680 and provides space for the heel 1340 to fold into and for the latch 1440 to fit and expand into. The shank 1420 may also have additional indents 1740 for support.

Figure 32:
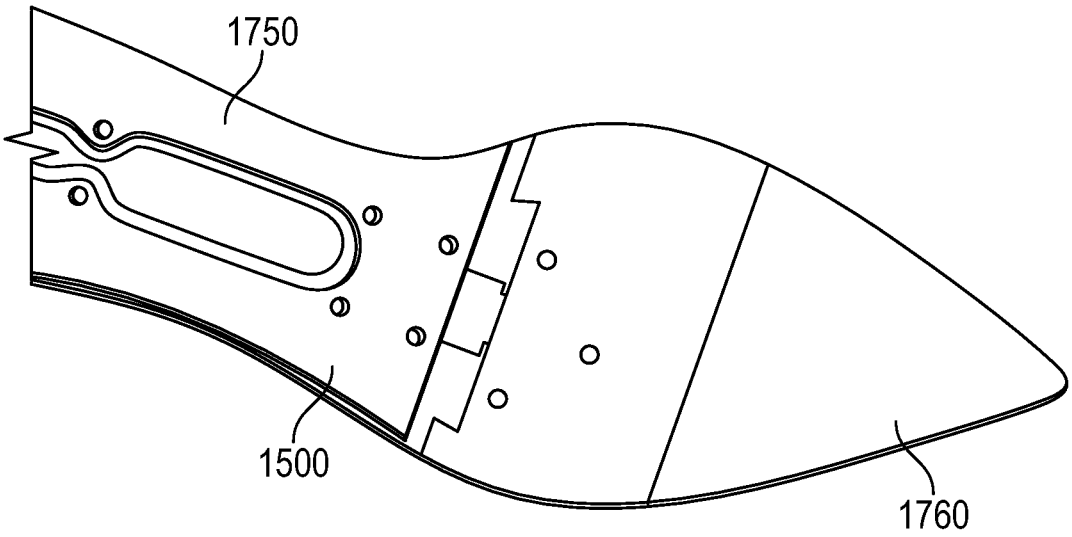
FIG. 32 is a perspective view of the convertible high heel and flat shoe of FIG. 1, and shows flexible materials between secured stiff materials.

The midsole assembly 1500 could be securely attached to the mechanical components or move relatively to them. When secured, stiff insole materials 1750 are adhered or screwed on to the mechanical parts. Foam or flexible materials 1760 are used to fill in gaps between the stiff materials or mechanical components (FIG. 32).

Figure 33:
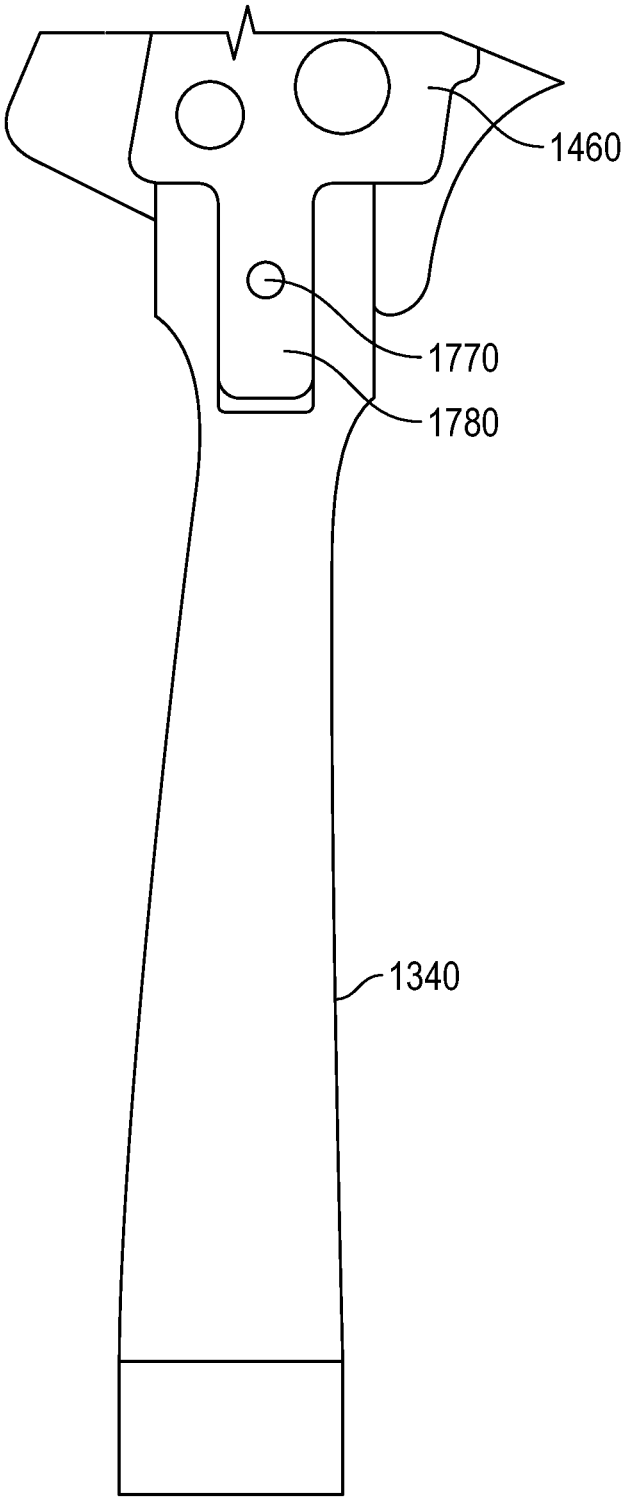
FIG. 33 is an enlarged side elevational view of heel assembly to block.

The heel 1340 is assembled to the block 1460 with a pin 1770, tapered piece or threaded stud 1780 (FIG. 33). The heel 1340 could be any shape or profile including rod, half dome, hex, oval, diamond, block, etc.

Figure 34:
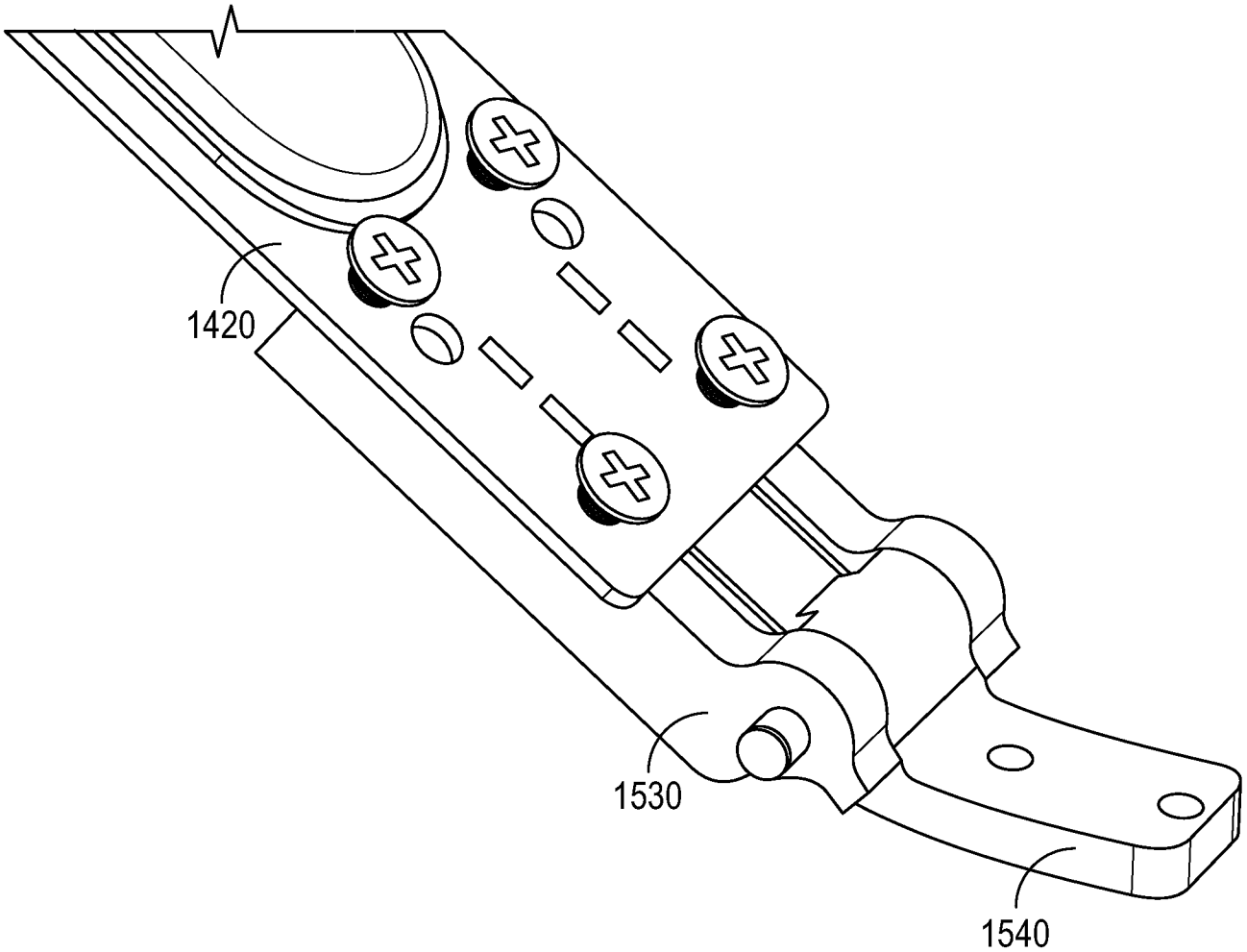
FIG. 34 is an enlarged side elevational view of a shank mechanism to accommodate different shoe sizes.

The shank 1420 is designed to accommodate different shoe sizes. The hinge or flexure 1530 of foot lock piece 1520 could be assembled on different locations on the shank 1420 to extend the length and lengthen or shorten the part as needed for different shoe sizes (FIG. 34).

The figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The invention claimed is:

1. A convertible high heel and flat shoe, comprising:

a sole including a heel section;

a high heel piece positionable between a high heel mode where the high heel piece supports the heel section and a flat shoe mode where the high heel piece is received within the sole, wherein the sole includes a receiving section to receive the high heel piece within the sole, an openable sole cover that covers and uncovers the receiving section of the sole, the openable sole cover including a hole therein that the high heel piece extends through in the high heel mode.

2. The convertible high heel and flat shoe of claim 1, wherein the sole includes a midsole with an adaptable arc and shape between the high heel mode and the flat shoe mode, the sole includes a flexure with a lock configured to automatically lock when the high heel piece is positioned in the high heel mode and automatically unlock when the high heel piece is positioned in the flat mode.

3. The convertible high heel and flat shoe of claim 2, wherein the lock includes a hinge, a groove, and a wedge piece wherein, in a lock mode and the high heel mode, the wedge piece uses spring force to push into the groove of the lock, preventing the hinge from moving freely, and, in an unlock mode or the flat shoe mode, the wedge piece is moved out of the groove, allowing the hinge to move freely.

4. The convertible high heel and flat shoe of claim 3, further including a rod and notch combination to prevent hinge motion in one direction.

5. The convertible high heel and flat shoe of claim 4, wherein the wedge piece prevents movement in direction opposite the one direction.

6. The convertible high heel and flat shoe of claim 1, further including a heel locking mechanism configured to lock in the high heel mode where the high heel piece supports the heel section and unlock in the flat shoe mode where the high heel piece is received within the sole.

7. A convertible high heel and flat shoe, comprising:

a sole including a heel section;

a high heel piece positionable between a high heel mode where the high heel piece supports the heel section and a flat shoe mode where the high heel piece is received within the sole, wherein the sole includes a midsole with an adaptable arc and shape between the high heel mode and the flat shoe mode, the sole includes a flexure with a lock configured to automatically lock when the high heel piece is positioned in the high heel mode and automatically unlock when the high heel piece is positioned in the flat mode.

8. The convertible high heel and flat shoe of claim 7, wherein the lock includes a hinge, a groove, and a wedge piece wherein, in a lock mode and the high heel mode, the wedge piece uses spring force to push into the groove of the lock, preventing the hinge from moving freely, and, in an unlock mode or the flat shoe mode, the wedge piece is moved out of the groove, allowing the hinge to move freely.

9. The convertible high heel and flat shoe of claim 8, further including a rod and notch combination to prevent hinge motion in one direction.

10. The convertible high heel and flat shoe of claim 9, wherein the wedge piece prevents movement in direction opposite the one direction.

11. The convertible high heel and flat shoe of claim 7, further including a heel locking mechanism configured to lock in the high heel mode where the high heel piece supports the heel section and unlock in the flat shoe mode where the high heel piece is received within the sole.

12. The convertible high heel and flat shoe of claim 7, wherein the sole includes a receiving section to receive the high heel piece within the sole, an openable sole cover that covers and uncovers the receiving section of the sole, the openable sole cover including a hole therein that the high heel piece extends through in the high heel mode.

13. A convertible high heel and flat shoe, comprising:

a sole including a heel section;

a high heel piece positionable between a high heel mode where the high heel piece supports the heel section and a flat shoe mode where the high heel piece is received within the sole;

a heel locking mechanism configured to lock in the high heel mode where the high heel piece supports the heel section and unlock in the flat shoe mode where the high heel piece is received within the sole, wherein the heel locking mechanism includes a spring-loaded engagement member to disengage the heel locking mechanism when the spring-loaded engagement member is urged towards the sole when the high heel piece is in the high heel mode.

14. The convertible high heel and flat shoe of claim 13, wherein the heel locking mechanism includes a latch that is engaged when the heel locking mechanism is locked and disengaged when the heel locking mechanism is unlocked, and a spring that forces the latch as deep as possible into a locked position.

15. The convertible high heel and flat shoe of claim 13, wherein the heel locking mechanism includes a catch with a rearward facing portion and forward facing portion, a latch member with a rearward facing portion and forward facing portion, the rearward facing portion of the catch engages the forward facing forward portion of latch member in the heel mode, and the forward facing portion of the catch engages the rearward facing portion of the latch member in the flat mode.

16. The convertible high heel and flat shoe of claim 13, wherein the sole includes a receiving section to receive the high heel piece within the sole, an openable sole cover that covers and uncovers the receiving section of the sole, the openable sole cover including a hole therein that the high heel piece extends through in the high heel mode.

17. The convertible high heel and flat shoe of claim 13, wherein the sole includes a midsole with an adaptable arc and shape between the high heel mode and the flat shoe mode, the sole includes a flexure with a lock configured to automatically lock when the high heel piece is positioned in the high heel mode and automatically unlock when the high heel piece is positioned in the flat mode.

18. The convertible high heel and flat shoe of claim 1, wherein the openable sole cover is pivotally attached to the sole.

19. The convertible high heel and flat shoe of claim 1, wherein the openable sole cover is configured to be walked on, contacting a walking surface, in the flat shoe mode.

* * * * *